US010701505B2

(12) United States Patent
Copt et al.

(10) Patent No.: US 10,701,505 B2
(45) Date of Patent: Jun. 30, 2020

(54) SYSTEM, METHOD, AND APPARATUS FOR GENERATING AND DIGITALLY PROCESSING A HEAD RELATED AUDIO TRANSFER FUNCTION

(71) Applicant: Bongiovi Acoustics LLC., Port St. Lucie, FL (US)

(72) Inventors: Ryan J. Copt, Port St. Lucie, FL (US); Joseph G. Butera, III, Stuart, FL (US); Robert J. Summers, III, Port St. Lucie, FL (US); Anthony Bongiovi, Port St. Lucie, FL (US); Glenn Zelniker, Gainesville, FL (US); Phillip Fuller, New York, NY (US)

(73) Assignee: BONGIOVI ACOUSTICS LLC., Port St. Lucie, FL (US)

( * ) Notice: Subject to any disclaimer, the term of this patent is extended or adjusted under 35 U.S.C. 154(b) by 0 days.

(21) Appl. No.: 15/864,190

(22) Filed: Jan. 8, 2018

(65) Prior Publication Data

US 2018/0213343 A1 Jul. 26, 2018

Related U.S. Application Data

(63) Continuation-in-part of application No. 15/478,696, filed on Apr. 4, 2017, now abandoned, which is a (Continued)

(51) Int. Cl.
*H04R 5/02* (2006.01)
*H04S 7/00* (2006.01)
(Continued)

(52) U.S. Cl.
CPC ..... *H04S 7/302* (2013.01); *H04R 1/005* (2013.01); *H04R 1/1075* (2013.01); *H04R 1/342* (2013.01);
(Continued)

(58) Field of Classification Search
CPC ... H04S 7/302; H04S 2420/01; H04R 1/1016; H04R 5/027
(Continued)

(56) References Cited

U.S. PATENT DOCUMENTS 2,643,729 A 6/1953 McCracken
2,755,336 A 7/1956 Zener et al.
(Continued)

FOREIGN PATENT DOCUMENTS

AU 2005274099 10/2010
AU 20070325096 4/2012
(Continued)

OTHER PUBLICATIONS

NovaSound Int., http://www.novasoundint.com/new_page_t.htm, 2004.
(Continued)

*Primary Examiner* — Katherine A Faley
(74) *Attorney, Agent, or Firm* — Malloy & Malloy, PL

(57) ABSTRACT

The present invention provides for an apparatus, system, and method for generating a head related audio transfer function in real time. Specifically, the present invention utilizes unique structural components including a tragus structure and an antihelix structure in connection with a microphone in order to communicate the location of a sound in three dimensional space to a user. The invention also utilizes an audio processor to digitally process the head related audio transfer function.

18 Claims, 9 Drawing Sheets

Related U.S. Application Data continuation of application No. 14/485,145, filed on Sep. 12, 2014, now Pat. No. 9,615,189, application No. 15/864,190, filed on Jan. 8, 2018, which is a continuation-in-part of application No. 15/163,353, filed on May 24, 2016, now Pat. No. 10,069,471, which is a continuation-in-part of application No. 14/059,948, filed on Oct. 22, 2013, now Pat. No. 9,348,904, which is a continuation-in-part of application No. 12/648,007, filed on Dec. 28, 2009, now Pat. No. 8,565,449, which is a continuation-in-part of application No. 11/947,301, filed on Nov. 29, 2007, now Pat. No. 8,160,274, and a continuation-in-part of application No. 11/703,216, filed on Feb. 7, 2007, now abandoned.

(60) Provisional application No. 62/035,025, filed on Aug. 8, 2014, provisional application No. 60/861,711, filed on Nov. 30, 2006, provisional application No. 60/765,722, filed on Feb. 7, 2006.

(51) Int. Cl.

| | |
|---|---|
| *H04S 1/00* | (2006.01) |
| *H04R 5/033* | (2006.01) |
| *H04R 5/027* | (2006.01) |
| *H04R 1/34* | (2006.01) |
| *H04R 1/10* | (2006.01) |
| *H04R 1/00* | (2006.01) |
| *H04R 3/12* | (2006.01) |
| *H04R 3/04* | (2006.01) |

(52) U.S. Cl.

CPC ..... *H04R 3/04* (2013.01); *H04R 3/12* (2013.01); *H04R 5/027* (2013.01); *H04R 5/033* (2013.01); *H04R 2201/107* (2013.01); *H04R 2420/07* (2013.01); *H04R 2430/01* (2013.01); *H04S 1/007* (2013.01); *H04S 7/307* (2013.01); *H04S 2400/01* (2013.01); *H04S 2420/01* (2013.01)

(58) Field of Classification Search

USPC ..... 381/310, 311, 26, 380

See application file for complete search history.

(56) References Cited

U.S. PATENT DOCUMENTS

| | | | |
|---|---|---|---|
| 3,396,241 | A | 8/1968 | Anderson |
| 3,430,007 | A | 2/1969 | Thielen |
| 3,662,076 | A | 5/1972 | Gordon et al. |
| 3,795,876 | A | 3/1974 | Takashi et al. |
| 3,813,687 | A | 5/1974 | Geil |
| 4,162,462 | A | 7/1979 | Endoh et al. |
| 4,184,047 | A | 1/1980 | Langford |
| 4,215,583 | A | 8/1980 | Botsco et al. |
| 4,218,950 | A | 8/1980 | Uetrecht |
| 4,226,533 | A | 10/1980 | Snowman |
| 4,257,325 | A | 3/1981 | Bertagni |
| 4,277,367 | A | 7/1981 | Madsen et al. |
| 4,286,455 | A | 9/1981 | Ophir et al. |
| 4,331,021 | A | 5/1982 | Lopez et al. |
| 4,353,035 | A | 10/1982 | Schröder |
| 4,356,558 | A | 10/1982 | Owen et al. |
| 4,363,007 | A | 12/1982 | Haramoto et al. |
| 4,392,027 | A | 7/1983 | Bock |
| 4,399,474 | A | 8/1983 | Coleman, Jr. |
| 4,412,100 | A | 10/1983 | Orban |
| 4,458,362 | A | 7/1984 | Berkovitz et al. |
| 4,489,280 | A | 12/1984 | Bennett, Jr. et al. |
| 4,517,415 | A | 5/1985 | Laurence |
| 4,538,297 | A | 8/1985 | Waller |
| 4,549,289 | A | 10/1985 | Schwartz et al. |
| 4,584,700 | A | 4/1986 | Scholz |
| 4,602,381 | A | 7/1986 | Cugnini et al. |
| 4,612,665 | A | 9/1986 | Inami et al. |
| 4,641,361 | A | 2/1987 | Rosback |
| 4,677,645 | A | 6/1987 | Kaniwa et al. |
| 4,696,044 | A | 9/1987 | Waller, Jr. |
| 4,701,953 | A | 10/1987 | White |
| 4,704,726 | A | 11/1987 | Gibson |
| 4,715,559 | A | 12/1987 | Fuller |
| 4,739,514 | A | 4/1988 | Short et al. |
| 4,815,142 | A | 3/1989 | Imreh |
| 4,856,068 | A | 8/1989 | Quatieri, Jr. et al. |
| 4,887,299 | A | 12/1989 | Cummins et al. |
| 4,997,058 | A | 3/1991 | Bertagni |
| 5,007,707 | A | 4/1991 | Bertagni |
| 5,073,936 | A | 12/1991 | Gurike et al. |
| 5,133,015 | A | 7/1992 | Scholz |
| 5,195,141 | A | 3/1993 | Jang |
| 5,210,704 | A | 5/1993 | Husseiny |
| 5,210,806 | A | 5/1993 | Kihara et al. |
| 5,226,076 | A | 7/1993 | Baumhauer, Jr. et al. |
| 5,239,997 | A | 8/1993 | Guarino et al. |
| 5,355,417 | A | 10/1994 | Burdisso et al. |
| 5,361,381 | A | 11/1994 | Short |
| 5,384,856 | A | 1/1995 | Kyouno et al. |
| 5,420,929 | A | 5/1995 | Geddes et al. |
| 5,425,107 | A | 6/1995 | Bertagni et al. |
| 5,463,695 | A | 10/1995 | Werrbach |
| 5,465,421 | A | 11/1995 | McCormick et al. |
| 5,467,775 | A | 11/1995 | Callahan et al. |
| 5,473,214 | A | 12/1995 | Hildebrand |
| 5,515,444 | A | 5/1996 | Burdisso et al. |
| 5,539,835 | A | 7/1996 | Bertagni et al. |
| 5,541,866 | A | 7/1996 | Sato et al. |
| 5,572,443 | A | 11/1996 | Emoto et al. |
| 5,615,275 | A | 3/1997 | Bertagni |
| 5,617,480 | A | 4/1997 | Ballard et al. |
| 5,638,456 | A | 6/1997 | Conley et al. |
| 5,640,685 | A | 6/1997 | Komoda |
| 5,671,287 | A | 9/1997 | Gerzon |
| 5,693,917 | A | 12/1997 | Bertagni et al. |
| 5,699,438 | A | 12/1997 | Smith et al. |
| 5,727,074 | A | 3/1998 | Hildebrand |
| 5,737,432 | A | 4/1998 | Werrbach |
| 5,812,684 | A | 9/1998 | Mark |
| 5,828,768 | A | 10/1998 | Eatwell et al. |
| 5,832,097 | A | 11/1998 | Armstrong et al. |
| 5,838,805 | A | 11/1998 | Warnaka et al. |
| 5,848,164 | A | 12/1998 | Levine |
| 5,861,686 | A | 1/1999 | Lee |
| 5,862,461 | A | 1/1999 | Yoshizawa et al. |
| 5,872,852 | A | 2/1999 | Dougherty |
| 5,883,339 | A | 3/1999 | Greenberger |
| 5,901,231 | A | 5/1999 | Parrella et al. |
| 5,990,955 | A | 11/1999 | Koz |
| 6,002,777 | A | 12/1999 | Grasfield et al. |
| 6,058,196 | A | 5/2000 | Heron |
| 6,078,670 | A | 6/2000 | Beyer |
| 6,093,144 | A | 7/2000 | Jaeger et al. |
| 6,108,431 | A | 8/2000 | Bachler |
| 6,195,438 | B1 | 2/2001 | Yumoto et al. |
| 6,201,873 | B1 | 3/2001 | Dal Farra |
| 6,202,601 | B1 | 3/2001 | Ouellette et al. |
| 6,208,237 | B1 | 3/2001 | Saiki et al. |
| 6,220,866 | B1 | 4/2001 | Amend et al. |
| 6,244,376 | B1 | 6/2001 | Granzotto |
| 6,263,354 | B1 | 7/2001 | Gandhi |
| 6,285,767 | B1 | 9/2001 | Klayman |
| 6,292,511 | B1 | 9/2001 | Goldston et al. |
| 6,317,117 | B1 | 11/2001 | Goff |
| 6,318,797 | B1 | 11/2001 | Böhm et al. |
| 6,332,029 | B1 | 12/2001 | Azima et al. |
| 6,343,127 | B1 | 1/2002 | Billoud |
| 6,518,852 | B1 | 2/2003 | Derrick |
| 6,529,611 | B2 | 3/2003 | Kobayashi et al. |
| 6,535,846 | B1 | 3/2003 | Shashoua |
| 6,570,993 | B1 | 5/2003 | Fukuyama |
| 6,587,564 | B1 | 7/2003 | Cusson |

(56) References Cited

U.S. PATENT DOCUMENTS 6,618,487 B1 9/2003 Azima et al.
6,661,897 B2 12/2003 Smith
6,661,900 B1 12/2003 Allred et al.
6,772,114 B1 8/2004 Sluijter et al.
6,839,438 B1 1/2005 Riegelsberger et al.
6,847,258 B2 1/2005 Ishida et al.
6,871,525 B2 3/2005 Withnall et al.
6,907,391 B2 6/2005 Bellora et al.
6,999,826 B1 2/2006 Zhou et al.
7,006,653 B2 2/2006 Guenther
7,016,746 B2 3/2006 Wiser et al.
7,024,001 B1 4/2006 Nakada
7,058,463 B1 6/2006 Ruha et al.
7,123,728 B2 10/2006 King et al.
7,236,602 B2 6/2007 Gustavsson
7,254,243 B2 8/2007 Bongiovi
7,266,205 B2 9/2007 Miller
7,269,234 B2 9/2007 Klingenbrunn et al.
7,274,795 B2 9/2007 Bongiovi
7,430,300 B2 9/2008 Vosburgh et al.
7,519,189 B2 4/2009 Bongiovi
7,577,263 B2 8/2009 Tourwe
7,613,314 B2 11/2009 Camp, Jr.
7,676,048 B2 3/2010 Tsutsui
7,711,129 B2 5/2010 Lindahl
7,711,442 B2 5/2010 Ryle et al.
7,747,447 B2 6/2010 Christensen et al.
7,764,802 B2 7/2010 Oliver
7,778,718 B2 8/2010 Janke et al.
7,916,876 B1 3/2011 Helsloot
8,068,621 B2 11/2011 Okabayashi et al.
8,144,902 B2 3/2012 Johnston
8,160,274 B2 4/2012 Bongiovi
8,175,287 B2 5/2012 Ueno et al.
8,218,789 B2 7/2012 Bharitkar et al.
8,229,136 B2 7/2012 Bongiovi
8,284,955 B2 10/2012 Bongiovi et al.
8,385,864 B2 2/2013 Dickson et al.
8,462,963 B2 6/2013 Bongiovi
8,472,642 B2 6/2013 Bongiovi
8,503,701 B2 8/2013 Miles et al.
8,565,449 B2 10/2013 Bongiovi
8,577,676 B2 11/2013 Muesch
8,619,998 B2 12/2013 Walsh et al.
8,705,765 B2 4/2014 Bongiovi
8,750,538 B2 6/2014 Avendano et al.
8,811,630 B2 8/2014 Burlingame
8,879,743 B1 * 11/2014 Mitra ..... H04R 1/342 181/129
9,195,433 B2 11/2015 Bongiovi et al.
9,264,004 B2 2/2016 Bongiovi et al.
9,275,556 B1 3/2016 East et al.
9,276,542 B2 3/2016 Bongiovi et al.
9,281,794 B1 3/2016 Bongiovi et al.
9,344,828 B2 5/2016 Bongiovi et al.
9,348,904 B2 5/2016 Bongiovi et al.
9,350,309 B2 5/2016 Bongiovi et al.
9,397,629 B2 7/2016 Bongiovi et al.
9,398,394 B2 7/2016 Bongiovi et al.
9,413,321 B2 8/2016 Bongiovi et al.
9,564,146 B2 2/2017 Bongiovi et al.
9,615,189 B2 4/2017 Copt et al.
9,615,813 B2 4/2017 Copt et al.
9,621,994 B1 4/2017 Bongiovi et al.
9,638,672 B2 5/2017 Butera, III et al.
9,741,355 B2 8/2017 Bongiovi et al.
9,793,872 B2 10/2017 Bongiovi et al.
9,883,318 B2 1/2018 Bongiovi et al.
9,906,858 B2 2/2018 Bongiovi et al.
9,906,867 B2 2/2018 Bongiovi et al.
9,998,832 B2 6/2018 Bongiovi et al.
1,006,947 A1 9/2018 Bongiovi et al.
1,015,833 A1 12/2018 Bongiovi et al.
10,158,337 B2 12/2018 Bongiovi et al.
2001/0008535 A1 7/2001 Lanigan
2001/0043704 A1 11/2001 Schwartz
2001/0046304 A1 11/2001 Rast
2002/0057808 A1 5/2002 Goldstein
2002/0071481 A1 6/2002 Goodings
2002/0094096 A1 7/2002 Paritsky et al.
2002/0170339 A1 11/2002 Passi et al.
2003/0016838 A1 1/2003 Paritsky et al.
2003/0023429 A1 1/2003 Claesson et al.
2003/0035555 A1 2/2003 King et al.
2003/0043940 A1 3/2003 Janky et al.
2003/0112088 A1 6/2003 Bizjak
2003/0138117 A1 7/2003 Goff
2003/0142841 A1 7/2003 Wiegand
2003/0164546 A1 9/2003 Giger
2003/0179891 A1 9/2003 Rabinowitz et al.
2003/0216907 A1 11/2003 Thomas
2004/0003805 A1 1/2004 Ono et al.
2004/0005063 A1 1/2004 Klayman
2004/0008851 A1 * 1/2004 Hagiwara ..... H04S 3/00 381/104
2004/0022400 A1 2/2004 Magrath
2004/0042625 A1 3/2004 Brown
2004/0044804 A1 3/2004 Mac Farlane
2004/0086144 A1 5/2004 Kallen
2004/0103588 A1 6/2004 Allaei
2004/0105556 A1 6/2004 Grove
2004/0138769 A1 7/2004 Akiho
2004/0146170 A1 7/2004 Zint
2004/0189264 A1 9/2004 Matsuura et al.
2004/0208646 A1 10/2004 Choudhary et al.
2005/0013453 A1 1/2005 Cheung
2005/0090295 A1 4/2005 Ali et al.
2005/0117771 A1 * 6/2005 Vosburgh ..... H04S 1/002 381/376
2005/0129248 A1 6/2005 Kraemer et al.
2005/0175185 A1 8/2005 Korner
2005/0201572 A1 * 9/2005 Lindahl ..... H03G 5/165 381/103
2005/0249272 A1 11/2005 Kirkeby et al.
2005/0254564 A1 11/2005 Tsutsui
2006/0034467 A1 2/2006 Sleboda et al.
2006/0045294 A1 3/2006 Smyth
2006/0064301 A1 3/2006 Aguilar et al.
2006/0098827 A1 5/2006 Paddock et al.
2006/0115107 A1 6/2006 Vincent et al.
2006/0126851 A1 6/2006 Yuen et al.
2006/0126865 A1 6/2006 Blarney et al.
2006/0138285 A1 6/2006 Oleski et al.
2006/0140319 A1 6/2006 Eldredge et al.
2006/0153281 A1 7/2006 Karlsson
2006/0189841 A1 8/2006 Pluvinage
2006/0285696 A1 12/2006 Houtsma
2006/0291670 A1 12/2006 King et al.
2007/0010132 A1 1/2007 Nelson
2007/0030994 A1 2/2007 Ando et al.
2007/0056376 A1 3/2007 King
2007/0106179 A1 5/2007 Bagha et al.
2007/0119421 A1 5/2007 Lewis et al.
2007/0150267 A1 6/2007 Honma et al.
2007/0165872 A1 7/2007 Bridger et al.
2007/0173990 A1 7/2007 Smith et al.
2007/0177459 A1 8/2007 Behn
2007/0206643 A1 9/2007 Egan
2007/0223713 A1 9/2007 Gunness
2007/0223717 A1 9/2007 Boersma
2007/0253577 A1 11/2007 Yen et al.
2008/0031462 A1 2/2008 Walsh et al.
2008/0040116 A1 2/2008 Cronin
2008/0049948 A1 * 2/2008 Christoph ..... H04S 7/301 381/86
2008/0069385 A1 3/2008 Revit
2008/0093157 A1 4/2008 Drummond et al.
2008/0112576 A1 5/2008 Bongiovi
2008/0123870 A1 5/2008 Stark
2008/0123873 A1 5/2008 Bjorn-Josefsen et al.
2008/0137876 A1 6/2008 Kassan et al.
2008/0137881 A1 6/2008 Bongiovi
2008/0165989 A1 7/2008 Seil et al.
2008/0181424 A1 7/2008 Schulein et al.

(56) References Cited

U.S. PATENT DOCUMENTS

| | | | |
|---|---|---|---|
| 2008/0212798 | A1 | 9/2008 | Zartarian |
| 2008/0219459 | A1 | 9/2008 | Bongiovi et al. |
| 2008/0255855 | A1 | 10/2008 | Lee et al. |
| 2009/0022328 | A1 | 1/2009 | Neugebauer et al. |
| 2009/0054109 | A1 | 2/2009 | Hunt |
| 2009/0062946 | A1 | 3/2009 | Bongiovi et al. |
| 2009/0080675 | A1 | 3/2009 | Smirnov et al. |
| 2009/0086996 | A1 | 4/2009 | Bongiovi et al. |
| 2009/0116652 | A1 | 5/2009 | Kirkeby et al. |
| 2009/0211838 | A1 | 8/2009 | Bilan |
| 2009/0282810 | A1 | 11/2009 | Leone et al. |
| 2009/0290725 | A1 | 11/2009 | Huang |
| 2009/0296959 | A1 | 12/2009 | Bongiovi |
| 2010/0045374 | A1 | 2/2010 | Wu et al. |
| 2010/0166222 | A1 | 7/2010 | Bongiovi |
| 2010/0246832 | A1 | 9/2010 | Villemoes et al. |
| 2010/0256843 | A1 | 10/2010 | Bergstein et al. |
| 2010/0278364 | A1 | 11/2010 | Berg |
| 2010/0303278 | A1 | 12/2010 | Sahyoun |
| 2011/0002467 | A1 | 1/2011 | Nielsen |
| 2011/0007907 | A1 | 1/2011 | Park et al. |
| 2011/0013736 | A1 | 1/2011 | Tsukamoto et al. |
| 2011/0065408 | A1 | 3/2011 | Kenington et al. |
| 2011/0087346 | A1 | 4/2011 | Larsen et al. |
| 2011/0096936 | A1 | 4/2011 | Gass |
| 2011/0125063 | A1 | 5/2011 | Shalon et al. |
| 2011/0194712 | A1 | 8/2011 | Potard |
| 2011/0230137 | A1 | 9/2011 | Hicks et al. |
| 2011/0257833 | A1 | 10/2011 | Trush et al. |
| 2011/0280411 | A1 | 11/2011 | Cheah et al. |
| 2012/0008798 | A1 | 1/2012 | Ong |
| 2012/0014553 | A1 | 1/2012 | Bonanno |
| 2012/0020502 | A1 | 1/2012 | Adams |
| 2012/0022842 | A1 | 1/2012 | Amadu |
| 2012/0063611 | A1 | 3/2012 | Kimura |
| 2012/0089045 | A1 | 4/2012 | Seidl et al. |
| 2012/0099741 | A1 | 4/2012 | Gotoh et al. |
| 2012/0170759 | A1 | 7/2012 | Yuen et al. |
| 2012/0170795 | A1 | 7/2012 | Sancisi et al. |
| 2012/0189131 | A1 | 7/2012 | Ueno et al. |
| 2012/0213034 | A1 | 8/2012 | Imran |
| 2012/0213375 | A1 | 8/2012 | Mahabub et al. |
| 2012/0300949 | A1 | 11/2012 | Rauhala |
| 2012/0302920 | A1 | 11/2012 | Bridger et al. |
| 2012/0329904 | A1 | 12/2012 | Suita et al. |
| 2013/0083958 | A1 | 4/2013 | Katz et al. |
| 2013/0121507 | A1 | 5/2013 | Bongiovi et al. |
| 2013/0129106 | A1 | 5/2013 | Sapiejewski |
| 2013/0162908 | A1 | 6/2013 | Son et al. |
| 2013/0163767 | A1 | 6/2013 | Gauger, Jr. et al. |
| 2013/0163783 | A1 | 6/2013 | Burlingame |
| 2013/0169779 | A1 | 7/2013 | Pedersen |
| 2013/0220274 | A1 | 8/2013 | Deshpande et al. |
| 2013/0227631 | A1 | 8/2013 | Sharma et al. |
| 2013/0242191 | A1 | 9/2013 | Leyendecker |
| 2013/0251175 | A1 | 9/2013 | Bongiovi et al. |
| 2013/0288596 | A1 | 10/2013 | Suzuki et al. |
| 2013/0338504 | A1 | 12/2013 | Demos et al. |
| 2014/0067236 | A1 | 3/2014 | Henry et al. |
| 2014/0100682 | A1 | 4/2014 | Bongiovi |
| 2014/0112497 | A1 | 4/2014 | Bongiovi |
| 2014/0119583 | A1 | 5/2014 | Valentine et al. |
| 2014/0126734 | A1 | 5/2014 | Gauger, Jr. et al. |
| 2014/0153730 | A1 | 6/2014 | Habboushe et al. |
| 2014/0153765 | A1 | 6/2014 | Gan et al. |
| 2014/0185829 | A1 | 7/2014 | Bongiovi |
| 2014/0261301 | A1 | 9/2014 | Leone |
| 2014/0369504 | A1 | 12/2014 | Bongiovi |
| 2014/0369521 | A1 | 12/2014 | Bongiovi et al. |
| 2014/0379355 | A1 | 12/2014 | Hosokawsa |
| 2015/0039250 | A1 | 2/2015 | Rank |
| 2015/0194158 | A1 | 7/2015 | Oh et al. |
| 2015/0201272 | A1 | 7/2015 | Wong |
| 2015/0208163 | A1 | 7/2015 | Hallberg et al. |
| 2015/0215720 | A1 | 7/2015 | Carroll |
| 2015/0297169 | A1 | 10/2015 | Copt et al. |
| 2015/0297170 | A1 | 10/2015 | Copt et al. |
| 2015/0339954 | A1 | 11/2015 | East et al. |
| 2016/0036402 | A1 | 2/2016 | Bongiovi et al. |
| 2016/0044436 | A1 | 2/2016 | Copt et al. |
| 2016/0209831 | A1 | 7/2016 | Pal |
| 2016/0225288 | A1 | 8/2016 | East et al. |
| 2016/0240208 | A1 | 8/2016 | Bongiovi et al. |
| 2016/0258907 | A1 | 9/2016 | Butera, III et al. |
| 2016/0344361 | A1 | 11/2016 | Bongiovi et al. |
| 2016/0370285 | A1 | 12/2016 | Jang et al. |
| 2017/0020491 | A1 | 1/2017 | Ogawa |
| 2017/0033755 | A1 | 2/2017 | Bongiovi et al. |
| 2017/0041732 | A1 | 2/2017 | Bongiovi et al. |
| 2017/0122915 | A1 | 5/2017 | Vogt et al. |
| 2017/0188989 | A1 | 7/2017 | Copt et al. |
| 2017/0193980 | A1 | 7/2017 | Bongiovi et al. |
| 2017/0263158 | A1 | 9/2017 | East et al. |
| 2017/0272887 | A1 | 9/2017 | Copt et al. |
| 2017/0289695 | A1 | 10/2017 | Bongiovi et al. |
| 2017/0345408 | A1 | 11/2017 | Hong et al. |
| 2018/0077482 | A1 | 3/2018 | Yuan |
| 2018/0091109 | A1 | 3/2018 | Bongiovi et al. |
| 2018/0102133 | A1 | 4/2018 | Bongiovi et al. |
| 2018/0139565 | A1 | 5/2018 | Norris et al. |
| 2018/0226064 | A1 | 8/2018 | Seagriff et al. |
| 2019/0020950 | A1 | 1/2019 | Bongiovi et al. |
| 2019/0069114 | A1 | 2/2019 | Tai et al. |
| 2019/0075388 | A1 | 3/2019 | Schrader et al. |
| 2019/0318719 | A1 | 10/2019 | Bongiovi et al. |
| 2019/0387340 | A1 | 12/2019 | Audfray et al. |
| 2020/0053503 | A1 | 2/2020 | Butera, III et al. |

FOREIGN PATENT DOCUMENTS

| | | | |
|---|---|---|---|
| AU | 2012202127 | | 7/2014 |
| CA | 2533221 | | 6/1995 |
| CA | 2161412 | | 4/2000 |
| CA | 2854086 | | 12/2018 |
| CN | 1139842 | | 1/1997 |
| CN | 1173268 | A | 2/1998 |
| CN | 1221528 | A | 6/1999 |
| CN | 1357136 | A | 7/2002 |
| CN | 1391780 | | 1/2003 |
| CN | 1879449 | | 12/2006 |
| CN | 1910816 | A | 2/2007 |
| CN | 101163354 | | 4/2008 |
| CN | 101277331 | | 10/2008 |
| CN | 101518083 | | 8/2009 |
| CN | 101536541 | A | 9/2009 |
| CN | 101720557 | | 6/2010 |
| CN | 101946526 | A | 1/2011 |
| CN | 101964189 | | 2/2011 |
| CN | 102652337 | | 8/2012 |
| CN | 102754151 | | 10/2012 |
| CN | 102822891 | | 12/2012 |
| CN | 102855882 | | 1/2013 |
| CN | 103004237 | A | 3/2013 |
| CN | 203057339 | | 7/2013 |
| CN | 103247297 | | 8/2013 |
| CN | 103262577 | | 8/2013 |
| CN | 103348697 | | 10/2013 |
| CN | 103455824 | | 12/2013 |
| EP | 0206746 | B1 | 8/1992 |
| EP | 0541646 | | 1/1995 |
| EP | 0580579 | | 6/1998 |
| EP | 0698298 | | 2/2000 |
| EP | 0932523 | | 6/2000 |
| EP | 0666012 | | 11/2002 |
| EP | 2814267 | B1 | 10/2016 |
| ES | 2249788 | | 10/1998 |
| ES | 2219949 | | 8/1999 |
| GB | 2003707 | A | 3/1979 |
| GB | 2089986 | | 6/1982 |
| GB | 2320393 | | 12/1996 |
| ID | P0031074 | | 6/2012 |
| IS | 198914 | | 7/2014 |
| JP | 7106876 | | 4/1995 |
| JP | 4787255 | | 12/1995 |

(56) References Cited

FOREIGN PATENT DOCUMENTS

| | | |
|---|---|---|
| JP | 2005500768 | 1/2005 |
| JP | 2011059714 | 3/2011 |
| JP | 4787255 | 7/2011 |
| KR | 1020040022442 | 3/2004 |
| KR | 101503541 | 3/2015 |
| NZ | 553744 | 1/2009 |
| NZ | 574141 | 4/2010 |
| NZ | 557201 | 5/2012 |
| RU | 2483363 | 5/2013 |
| SU | 1319288 | 6/1987 |
| TW | 401713 | 8/2000 |
| WO | WO 9219080 | 10/1992 |
| WO | WO 1993011637 | 6/1993 |
| WO | WO 9321743 | 10/1993 |
| WO | WO 9427331 | 11/1994 |
| WO | WO 9514296 | 5/1995 |
| WO | WO 9531805 | 11/1995 |
| WO | WO 9535628 | 12/1995 |
| WO | WO 9601547 | 1/1996 |
| WO | WO 9611465 | 4/1996 |
| WO | WO 9708847 | 3/1997 |
| WO | WO 9709698 | 3/1997 |
| WO | WO 9709840 | 3/1997 |
| WO | WO 9709841 | 3/1997 |
| WO | WO 9709842 | 3/1997 |
| WO | WO 9709843 | 3/1997 |
| WO | WO 9709844 | 3/1997 |
| WO | WO 9709845 | 3/1997 |
| WO | WO 9709846 | 3/1997 |
| WO | WO 9709848 | 3/1997 |
| WO | WO 9709849 | 3/1997 |
| WO | WO 9709852 | 3/1997 |
| WO | WO 9709853 | 3/1997 |
| WO | WO 9709854 | 3/1997 |
| WO | WO 9709855 | 3/1997 |
| WO | WO 9709856 | 3/1997 |
| WO | WO 9709857 | 3/1997 |
| WO | WO 9709858 | 3/1997 |
| WO | WO 9709859 | 3/1997 |
| WO | WO 9709861 | 3/1997 |
| WO | WO 9709862 | 3/1997 |
| WO | WO 9717818 | 5/1997 |
| WO | WO 9717820 | 5/1997 |
| WO | WO 9813942 | 4/1998 |
| WO | WO 9816409 | 4/1998 |
| WO | WO 9828942 | 7/1998 |
| WO | WO 9831188 | 7/1998 |
| WO | WO 9834320 | 8/1998 |
| WO | WO 9839947 | 9/1998 |
| WO | WO 9842536 | 10/1998 |
| WO | WO 9843464 | 10/1998 |
| WO | WO 9852381 | 11/1998 |
| WO | WO 9852383 | 11/1998 |
| WO | WO 9853638 | 11/1998 |
| WO | WO 9902012 | 1/1999 |
| WO | WO 9908479 | 2/1999 |
| WO | WO 9911490 | 3/1999 |
| WO | WO 9912387 | 3/1999 |
| WO | WO 9913684 | 3/1999 |
| WO | WO 9921397 | 4/1999 |
| WO | WO 9935636 | 7/1999 |
| WO | WO 9935883 | 7/1999 |
| WO | WO 9937121 | 7/1999 |
| WO | WO 9938155 | 7/1999 |
| WO | WO 9941939 | 8/1999 |
| WO | WO 9952322 | 10/1999 |
| WO | WO 9952324 | 10/1999 |
| WO | WO 9956497 | 11/1999 |
| WO | WO 9962294 | 12/1999 |
| WO | WO 9965274 | 12/1999 |
| WO | WO 0001264 | 1/2000 |
| WO | WO 0002417 | 1/2000 |
| WO | WO 0007408 | 2/2000 |
| WO | WO 0007409 | 2/2000 |
| WO | WO 0013464 | 3/2000 |
| WO | WO 0015003 | 3/2000 |
| WO | WO 0033612 | 6/2000 |
| WO | WO 0033613 | 6/2000 |
| WO | WO 03104924 | 12/2003 |
| WO | WO 2006020427 | 2/2006 |
| WO | WO 2007092420 | 8/2007 |
| WO | WO 2008067454 | 6/2008 |
| WO | WO 2009070797 | 6/2009 |
| WO | WO 2009102750 | 8/2009 |
| WO | WO 2009114746 | 9/2009 |
| WO | WO 2009155057 | 12/2009 |
| WO | WO 2010027705 | 3/2010 |
| WO | WO 2010051354 | 5/2010 |
| WO | WO 2011081965 | 7/2011 |
| WO | WO 2012134399 | 10/2012 |
| WO | WO 2013055394 | 4/2013 |
| WO | WO 2013076223 | 5/2013 |
| WO | WO 2014201103 | 12/2014 |
| WO | WO 2015061393 | 4/2015 |
| WO | WO 2015077681 | 5/2015 |
| WO | WO 2015161034 | 10/2015 |
| WO | WO 2016019263 | 2/2016 |
| WO | WO 2016022422 | 2/2016 |
| WO | WO 2016144861 A1 | 9/2016 |
| WO | 2020028833 | 2/2020 |

OTHER PUBLICATIONS

Sepe, Michael. "Density & Molecular Weight in Polyethylene." Plastic Technology. Gardner Business Media, Inc., May 29, 2012. Web. http://ptonline.com/columns/density-molecular-weight-in-polyethylene. Stephan Peus et al. "Naturliche Horen mite kunstlichem Kopf", Funkschau — Zeitschrift fur.

* cited by examiner

SYSTEM, METHOD, AND APPARATUS FOR GENERATING AND DIGITALLY PROCESSING A HEAD RELATED AUDIO TRANSFER FUNCTION

CLAIM OF PRIORITY

The present application is a continuation-in-part of a previously filed, now pending application having Ser. No. 15/478,696 and a filing date of Apr. 4, 2017, which is a continuation application of a previously filed application having Ser. No. 14/485,145 and a filing date of Sep. 12, 2014, which matured into U.S. Pat. No. 9,615,189, and which is based on, and a claim of priority was made under 35 U.S.C. Section 119(e), to a provisional patent application having Ser. No. 62/035,025 and a filing date of Aug. 8, 2014, all of which are explicitly incorporated herein by reference, in their entireties.

The present invention is also a continuation in part of a previously filed, now pending application having Ser. No. 15/163,353 and a filing date of May 24, 2016, which is a continuation-in-part of Ser. No. 14/059,948, which matured into U.S. Pat. No. 9,348,904, and which is a continuation-in-part of Ser. No. 12/648,007 filed on Dec. 28, 2009, which matured into U.S. Pat. No. 8,565,449, and which is a continuation-in-part of Ser. No. 11/947,301, filed Nov. 29, 2007, which matured into U.S. Pat. No. 8,160,274, and which claims priority to U.S. Provisional Application No. 60/861,711 filed Nov. 30, 2006, each which are explicitly incorporated herein by reference, in there entireties. Further, Ser. No. 11/947,301 is a continuation-in-part of Ser. No. 11/703,216, filed Feb. 7, 2007, and which claims priority to U.S. Provisional Application No. 60/765,722 filed Feb. 7, 2006, each which are explicitly incorporated herein by reference, in there entireties

FIELD OF THE INVENTION

The present invention provides for a system and apparatus for generating a real time head related audio transfer function. Specifically, unique structural components are utilized in connection with a microphone to reproduce certain acoustic characteristics of the human pinna in order to facilitate the communication of the location of a sound in three dimensional space to a user. The invention may further utilize an audio processor to digitally process the head related audio transfer function.

BACKGROUND OF THE INVENTION

Human beings have just two ears, but can locate sounds in three dimensions, in distance and in direction. This is possible because the brain, the inner ears, and the external ears (pinna) work together to make inferences about the location of a sound. The location of a sound is estimated by taking cues derived from one ear (monoaural cues), as well as by comparing the difference between the cues received in both ears (binaural cues).

Binaural cues relate to the differences of arrival and intensity of the sound between the two ears, which assist with the relative localization of a sound source. Monoaural cues relate to the interaction between the sound source and the human anatomy, in which the original sound is modified by the external ear before it enters the ear canal for processing by the auditory system. The modifications encode the source location relative to the ear location and are known as head-related transfer functions (HRTF).

In other words, HRTFs describe the filtering of a sound source before it is perceived at the left and right ear drums, in order to characterize how a particular ear receives sound from a particular point in space. These modifications may include the shape of the listener's ear, the shape of the listener's head and body, the acoustical characteristics of the space in which the sound is played, and so forth. All these characteristics together influence how a listener can accurately tell what direction a sound is coming from. Thus, a pair of HRTFs accounting for all these characteristics, generated by the two ears, can be used to synthesize a binaural sound and accurately recognize it as originating from a particular point in space.

HRTFs have wide ranging applications, from virtual surround sound in media and gaming, to hearing protection in loud noise environments, and hearing assistance for the hearing impaired. Particularly, in fields hearing protection and hearing assistance, the ability to record and reconstruct a particular user's HRTF presents several challenges as it must occur in real time. In the case of an application for hearing protection in high noise environments, heavy hearing protection hardware must be worn over the ears in the form of bulky headphones, thus, if microphones are placed on the outside of the headphones, the user will hear the outside world but will not receive accurate positional data because the HRTF is not being reconstructed. Similarly, in the case of hearing assistance for the hearing impaired, a microphone is similarly mounted external to the hearing aid, and any hearing aid device that fully blocks a user's ear canal will not accurately reproduce that user's HRTF.

Thus, there is a need for an apparatus and system for reconstructing a user's HRTF in accordance to the user's physical characteristics, in order to accurately relay positional sound information to the user in real time.

SUMMARY OF THE INVENTION

The present invention meets the existing needs described above by providing for an apparatus, system, and method for generating a head related audio transfer function. The present invention also provides for the ability to enhance audio in real-time and tailors the enhancement to the physical characteristics of a user and the acoustic characteristics of the external environment.

Accordingly, in initially broad terms, an apparatus directed to the present invention, also known as an HRTF generator, comprises an external manifold and internal manifold. The external manifold is exposed at least partially to an external environment, while the internal manifold is disposed substantially within an interior of the apparatus and/or a larger device or system housing said apparatus.

The external manifold comprises an antihelix structure, a tragus structure, and an opening. The opening is in direct air flow communication with the outside environment, and is structured to receive acoustic waves. The tragus structure is disposed to partially enclose the opening, such that the tragus structure will partially impede and/or affect the characteristics of the incoming acoustic waves going into the opening. The antihelix structure is disposed to further partially enclose the tragus structure as well as the opening, such that the antihelix structure will partially impede and/or affect the characteristics of the incoming acoustic waves flowing onto the tragus structure and into the opening. The antihelix and tragus structures may comprise semi-domes or any variation of partial-domes comprising a closed side and an open side. In a preferred embodiment, the open side of the antihelix structure and the open side of the tragus structure are disposed in confronting relation to one another.

The opening of the external manifold is connected to and in air flow communication with an opening canal inside the external manifold. The opening canal may be disposed in a substantially perpendicular orientation relative to the desired orientation of the user. The opening canal is in further air flow communication with an auditory canal, which is formed within the internal manifold but also be formed partially in the external manifold.

The internal manifold comprises the auditory canal and a microphone housing. The microphone housing is attached or connected to an end of the auditory canal on the opposite end to its connection with the opening canal. The auditory canal, or at least the portion of the portion of the auditory canal, may be disposed in a substantially parallel orientation relative to the desired listening direction of the user. The microphone housing may further comprise a microphone mounted against the end of the auditory canal. The microphone housing may further comprise an air cavity behind the microphone on an end opposite its connection to the auditory canal, which may be sealed with a cap.

In at least one embodiment, the apparatus or HRTF generator may form a part of a larger system. Accordingly, the system may comprise a left HRTF generator, a right HRTF generator, a left preamplifier, a right preamplifier, an audio processor, a left playback module, and a right playback module.

As such, the left HRTF generator may be structured to pick up and filter sounds to the left of a user. Similarly, the right HRTF generator may be structured to pick up and filter sounds to the right of the user. A left preamplifier may be structured and configured to increase the gain of the filtered sound of the left HRTF generator. A right preamplifier may be structured and configured to increase the gain of the filtered sound of the right HRTF generator. The audio processor may be structured and configured to process and enhance the audio signal received from the left and right preamplifiers, and then transmit the respective processed signals to each of the left and right playback modules. The left and right playback modules or transducers are structured and configured to convert the electrical signals into sound to the user, such that the user can then perceive the filtered and enhanced sound from the user's environment, which includes audio data that allows the user to localize the source of the originating sound.

In at least one embodiment, the system of the present invention may comprise a wearable device such as a headset or headphones having the HRTF generator embedded therein. The wearable device may further comprise the preamplifiers, audio processor, and playback modules, as well as other appropriate circuitry and components.

In a further embodiment, a method for generating a head related audio transfer function may be used in accordance with the present invention. As such, external sound is first filtered through an exterior of an HRTF generator which may comprise a tragus structure and an antihelix structure. The filtered sound is then passed to the interior of the HRTF generator, such as through the opening canal and auditory canal described above to create an input sound. The input sound is received at a microphone embedded within the HRTF generator adjacent to and connected to the auditory canal in order to create an input signal. The input signal is amplified with a preamplifier in order to create an amplified signal. The amplified signal is then processed with an audio processor, in order to create a processed signal. Finally, the processed signal is transmitted to the playback module in order to relay audio and/or locational audio data to a user.

In certain embodiments, the audio processor may receive the amplified signal and first filter the amplified signal with a high pass filter. The high pass filter, in at least one embodiment, is configured to remove ultra-low frequency content from the amplified signal resulting in the generation of a high pass signal.

The high pass signal from the high pass filter is then filtered through a first filter module to create a first filtered signal. The first filter module is configured to selectively boost and/or attenuate the gain of select frequency ranges in an audio signal, such as the high pass signal. In at least one embodiment, the first filter module boosts frequencies above a first frequency, and attenuates frequencies below a first frequency.

The first filtered signal from the first filter module is then modulated with a first compressor to create a modulated signal. The first compressor is configured for the dynamic range compression of a signal, such as the first filtered signal. Because the first filtered signal boosted higher frequencies and attenuated lower frequencies, the first compressor may, in at least one embodiment, be configured to trigger and adjust the higher frequency material, while remaining relatively insensitive to lower frequency material.

The modulated signal from the first compressor is then filtered through a second filter module to create a second filtered signal. The second filter module is configured to selectively boost and/or attenuate the gain of select frequency ranges in an audio signal, such as the modulated signal. In at least one embodiment, the second filter module is configured to be of least partially inverse relation relative to the first filter module. For example, if the first filter module boosted content above a first frequency by +X dB and attenuated content below a first frequency by −Y dB, the second filter module may then attenuate the content above the first frequency by −X dB, and boost the content below the first frequency by +Y dB. In other words, the purpose of the second filter module in one embodiment may be to "undo" the gain adjustment that was applied by the first filter module.

The second filtered signal from the second filter module is then processed with a first processing module to create a processed signal. In at least one embodiment, the first processing module may comprise a peak/dip module. In other embodiments, the first processing module may comprise both a peak/dip module and a first gain element. The first gain element may be configured to adjust the gain of the signal, such as the second filtered signal. The peak/dip module may be configured to shape the signal, such as to increase or decrease overshoots or undershoots in the signal.

The processed signal from the first processing module is then split with a band splitter into a low band signal, a mid band signal and a high band signal. In at least one embodiment, each band may comprise the output of a fourth order section, which may be realized as the cascade of second order biquad filters.

The low band signal is modulated with a low band compressor to create a modulated low band signal, and the high band signal is modulated with a high band compressor to create a modulated high band signal. The low band compressor and high band compressor are each configured to dynamically adjust the gain of a signal. Each of the low band compressor and high band compressor may be computationally and/or configured identically as the first compressor.

The modulated low band signal, the mid band signal, and the modulated high band signal are then processed with a second processing module. The second processing module may comprise a summing module configured to combine the signals. The summing module in at least one embodiment may individually alter the gain of each of the modulated low band, mid band, and modulated high band signals. The second processing module may further comprise a second gain element. The second gain element may adjust the gain of the combined signal in order to create a processed signal that is transmitted to the playback module.

The method described herein may be configured to capture and transmit locational audio data to a user in real time, such that it can be utilized as a hearing aid, or in loud noise environments to filter out loud noises.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE EMBODIMENT

As illustrated by the accompanying drawings, the present invention is directed to an apparatus, system, and method for generating a head related audio transfer function for a user. Specifically, some embodiments relate to capturing surrounding sound in the external environment in real time, filtering that sound through unique structures formed on the apparatus in order to generate audio positional data, and then processing that sound to enhance and relay the positional audio data to a user, such that the user can determine the origination of the sound in three dimensional space.

Figure 1:
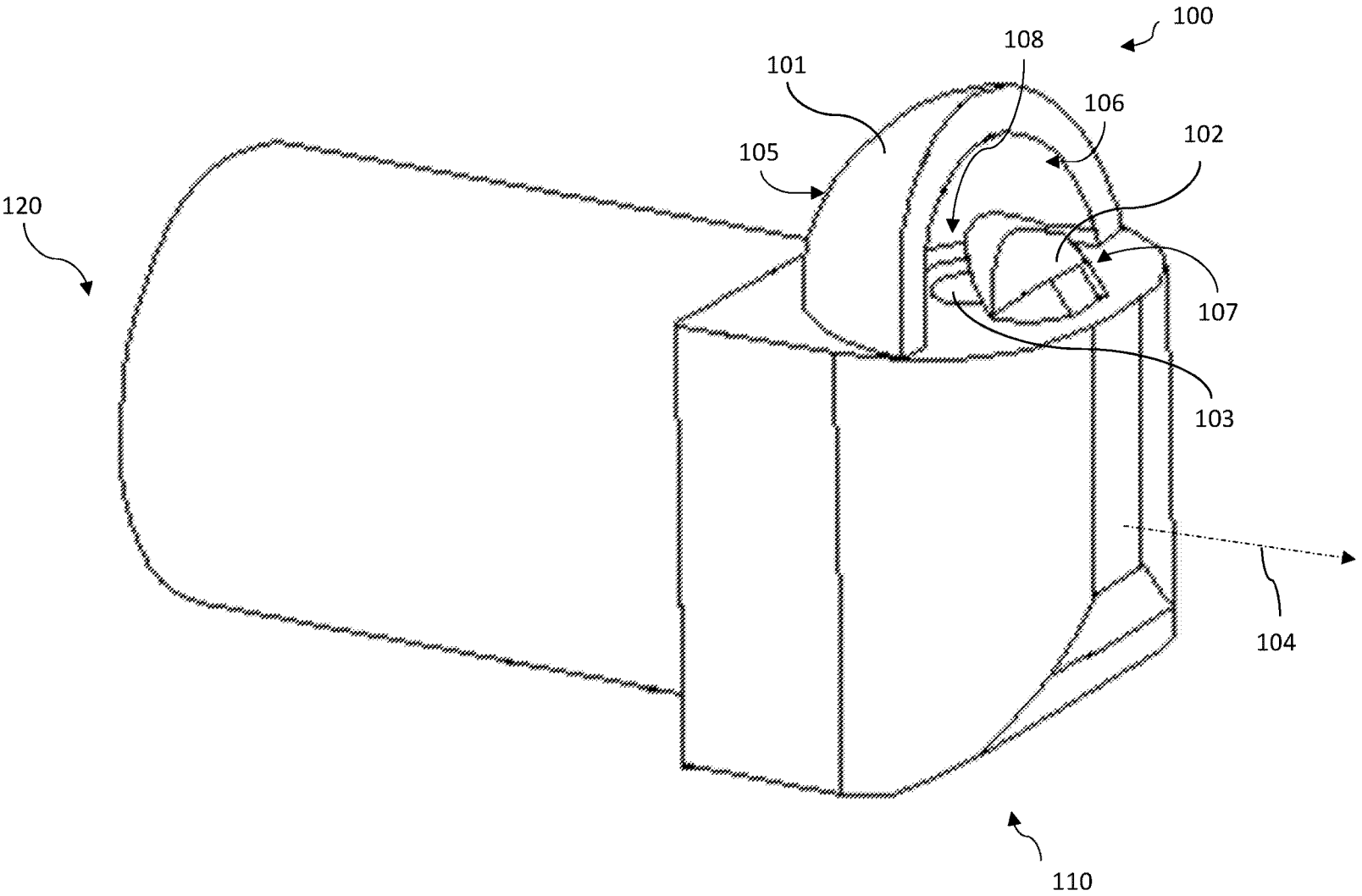
FIG. 1 is a perspective external view of an apparatus for generating a head related audio transfer function.
Figure 2:
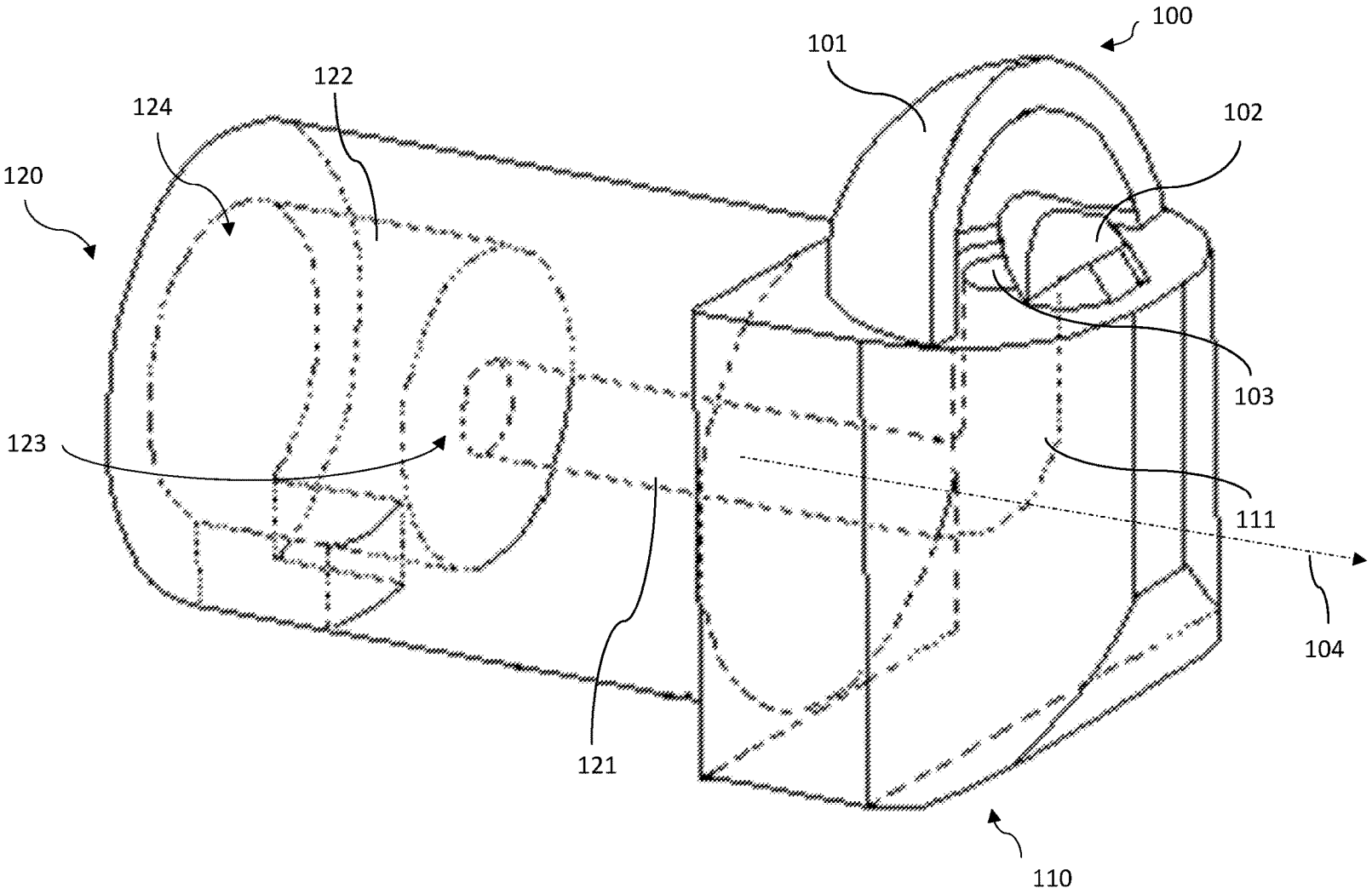
FIG. 2 is a perspective internal view of an apparatus for generating a head related audio transfer function.

As schematically represented, FIGS. 1 and 2 illustrate at least one preferred embodiment of an apparatus 100 for generating a head related audio transfer function for a user, or "HRTF generator". Accordingly, apparatus 100 comprises an external manifold 110 and an internal manifold 120. The external manifold 110 will be disposed at least partially on an exterior of the apparatus 100. The internal manifold 120, on the other hand, will be disposed along an interior of the apparatus 100. For further clarification, the exterior of the apparatus 100 comprises the external environment, such that the exterior is directly exposed to the air of the surrounding environment. The interior of the apparatus 100 comprises at least a partially sealed off environment that partially or fully obstructs the direct flow of acoustic waves.

The external manifold 110 may comprise a hexahedron shape having six faces. In at least one embodiment, the external manifold 110 is substantially cuboid. The external manifold 110 may comprise at least one surface that is concave or convex, such as an exterior surface exposed to the external environment. The internal manifold 120 may comprise a substantially cylindrical shape, which may be at least partially hollow. The external manifold 110 and internal manifold 120 may comprise sound dampening or sound proof materials, such as various foams, plastics, and glass known to those skilled in the art.

Drawing attention to FIG. 1, the external manifold 110 comprises an antihelix structure 101, a tragus structure 102, and an opening 103 that are externally visible. The opening 103 is in direct air flow communication with the surrounding environment, and as such will receive a flow of acoustic waves or vibrations in the air that passes through the opening 103. The tragus structure 102 is disposed to partially enclose the opening 103, and the antihelix structure 101 is disposed to partially enclose both the antihelix structure 102 and the opening 103.

In at least one embodiment, the antihelix structure 101 comprises a semi-dome structure having a closed side 105 and an open side 106. In a preferred embodiment, the open side 106 faces the preferred listening direction 104, and the closed side 105 faces away from the preferred listening direction 104. The tragus structure 102 may also comprise a semi-dome structure having a closed side 107 and an open side 108. In a preferred embodiment, the open side 108 faces away from the preferred listening direction 104, while the closed side 107 faces towards the preferred listening direction 104. In other embodiments, the open side 106 of the antihelix structure 101 may be in direct confronting relation to the open side 108 of the tragus structure 102, regardless of the preferred listening direction 104.

Semi-dome as defined for the purposes of this document may comprise a half-dome structure or any combination of partial-dome structures. For instance, the anti-helix structure 101 of FIG. 1 comprises a half-dome, while the tragus structure 102 comprises a partial-dome wherein the base portion may be less than that of a half-dome, but the top portion may extend to or beyond the halfway point of a half-dome to provide increased coverage or enclosure of the opening 103 and other structures. Of course, in other variations, the top portion and bottom portion of the semi-dome may vary in respective dimensions to form varying portions of a full dome structure, in order to create varying coverage of the opening 103. This allows the apparatus to produce different or enhanced acoustic input for calculating direction and distance of the source sound relative to the user.

In at least one embodiment, the antihelix structure 101 and tragus structure 102 may be modular, such that different sizes or shapes (variations of different semi-domes or partial-domes) may be swapped out based on a user's preference for particular acoustic characteristics.

Drawing attention now to FIG. 2, the opening 103 is connected to, and in air flow communication with, an opening canal 111 inside the external manifold 110. In at least one embodiment, the opening canal 111 is disposed in a substantially perpendicular orientation relative to the desired listening direction 104 of the user. The opening canal 111 is further connected in air flow communication with an auditory canal 121. A portion of the auditory canal 121 may be formed in the external manifold 110. In various embodiments, the opening canal 111 and auditory canal 121 may be of a single piece constructions. In other embodiments, a canal connector not shown may be used to connect the two segments. At least a portion of the auditory canal 121 may also be formed within the internal manifold 121.

As previously discussed, the internal manifold 120 is formed wholly or substantially within an interior of the apparatus, such that it is not exposed directly to the outside air and will not be substantially affected by the external environment. In at least one embodiment, the auditory canal 121 formed within at least a portion of the internal manifold 121, will be disposed in a substantially parallel orientation relative to desired listening direction 104 of the user. In a preferred embodiment, the auditory canal comprises a length that is greater than two times its diameter.

A microphone housing 122 is attached to an end of the auditory canal 121. Within the microphone housing 122, a microphone generally at 123, not shown, is mounted against the end of the auditory canal 121. In at least one embodiment, the microphone 123 is mounted flush against the auditory canal 121, such that the connection may be substantially air tight to avoid interference sounds. In a preferred embodiment, an air cavity generally at 124 is created behind the microphone and at the end of the internal manifold 120. This may be accomplished by inserting the microphone 123 into the microphone housing 122, and then sealing the end of the microphone housing, generally at 124, with a cap. The cap may be substantially air tight in at least one embodiment. Different gasses having different acoustic characteristics may be used within the air cavity.

Figure 3:
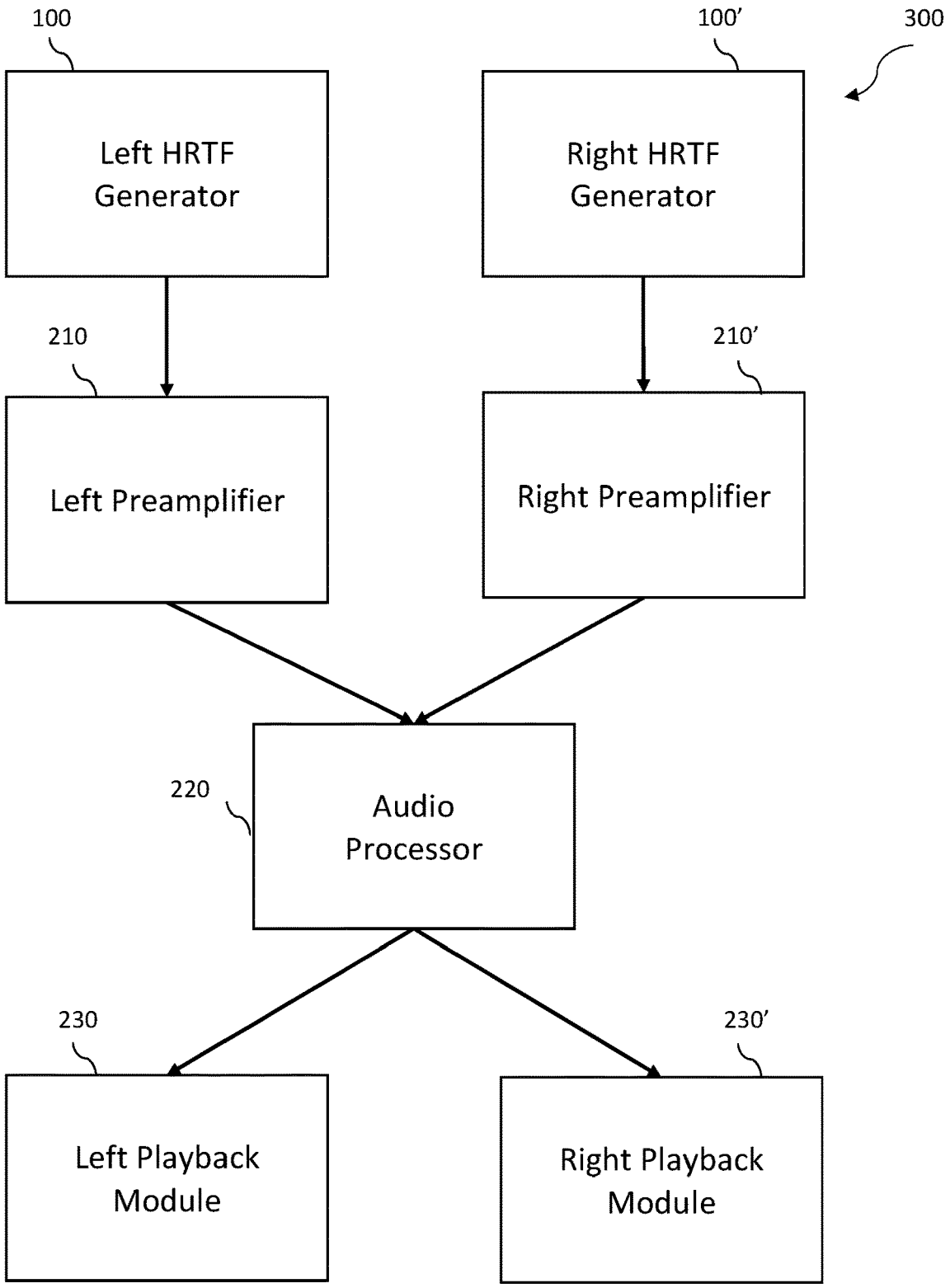
FIG. 3 is a block diagram directed to a system for generating a head related audio transfer function.

In at least one embodiment, apparatus 100 may form a part of a larger system 300 as illustrated in FIG. 3. Accordingly, a system 300 may comprise a left HRTF generator 100, a right HRTF generator 100', a left preamplifier 210, a right preamplifier 210', an audio processor 220, a left playback module 230, and a right playback module 230'.

The left and right HRTF generators 100 and 100' may comprise the apparatus 100 described above, each having unique structures such as the antihelix structure 101 and tragus structure 102. Accordingly, the HRTF generators 100/100' may be structured to generate a head related audio transfer function for a user, such that the sound received by the HRTF generators 100/100' may be relayed to the user to accurately communicate position data of the sound. In other words, the HRTF generators 100/100' may replicate and replace the function of the user's own left and right ears, where the HRTF generators would collect sound, and perform respective spectral transformations or a filtering process to the incoming sounds to enable the process of vertical localization to take place.

A left preamplifier 210 and right preamplifier 210' may then be used to enhance the filtered sound coming from the HRTF generators, in order to enhance certain acoustic characteristics to improve locational accuracy, or to filter out unwanted noise. The preamplifiers 210/210' may comprise an electronic amplifier, such as a voltage amplifier, current amplifier, transconductance amplifier, transresistance amplifier and/or any combination of circuits known to those skilled in the art for increasing or decreasing the gain of a sound or input signal. In at least one embodiment, the preamplifier comprises a microphone preamplifier configured to prepare a microphone signal to be processed by other processing modules. As it may be known in the art, microphone signals sometimes are too weak to be transmitted to other units, such as recording or playback devices with adequate quality. A microphone preamplifier thus increases a microphone signal to the line level by providing stable gain while preventing induced noise that might otherwise distort the signal.

Audio processor 230 may comprise a digital signal processor and amplifier, and may further comprise a volume control. Audio processor 230 may comprise a processor and combination of circuits structured to further enhance the audio quality of the signal coming from the microphone preamplifier, such as but not limited to shelf filters, equalizers, modulators. For example, in at least one embodiment the audio processor 230 may comprise a processor that performs the steps for processing a signal as taught by the present inventor's U.S. Pat. No. 8,160,274, the entire disclosure of which is incorporated herein by reference. Audio processor 230 may incorporate various acoustic profiles customized for a user and/or for an environment, such as those described in the present inventor's U.S. Pat. No. 8,565,449, the entire disclosure of which is incorporated herein by reference. Audio processor 230 may additionally incorporate processing suitable for high noise environments, such as those described in the present inventor's U.S. Pat. No. 8,462,963, the entire disclosure of which is incorporated herein by reference. Parameters of the audio processor 230 may be controlled and modified by a user via any means known to one skilled in the art, such as by a direct interface or a wireless communication interface.

The left playback module 230 and right playback module 230' may comprise headphones, earphones, speakers, or any other transducer known to one skilled in the art. The purpose of the left and right playback modules 230/230' is to convert the electrical audio signal from the audio processor 230 back into perceptible sound for the user. As such, a moving-coil transducer, electrostatic transducer, electret transducer, or other transducer technologies known to one skilled in the art may be utilized.

Figure 4A:
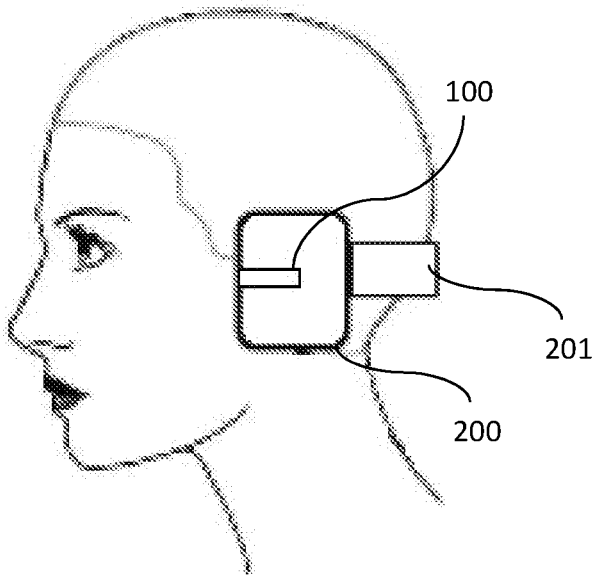
FIG. 4A illustrates a side profile view of a wearable device comprising an apparatus for generating a head related audio transfer function.
Figure 4B:
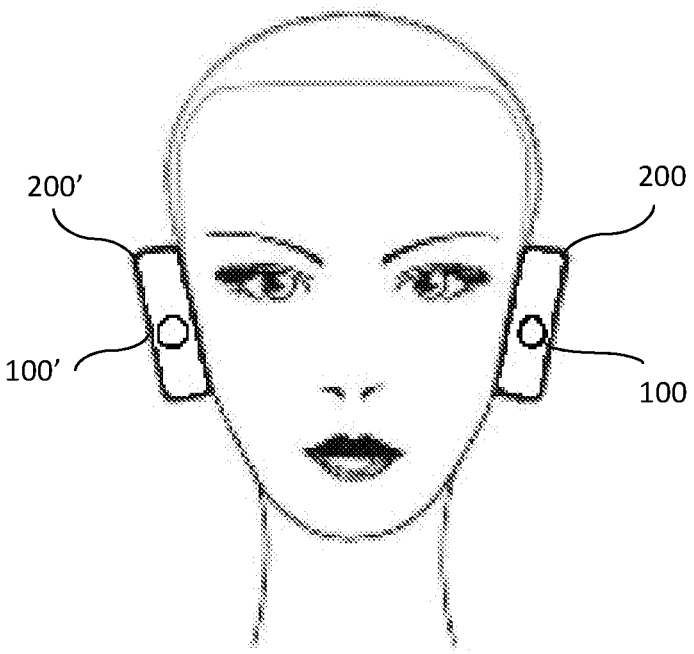
FIG. 4B illustrates a front profile view of a wearable device comprising an apparatus for generating a head related audio transfer function.

In at least one embodiment, the present system 200 comprises a device 200 as generally illustrated at FIGS. 4A and 4B, which may be a wearable headset 200 having the apparatus 100 embedded therein, as well as various amplifiers including but not limited to 210/210', processors such as 220, playback modules such as 230/230', and other appropriate circuits or combinations thereof for receiving, transmitting, enhancing, and reproducing sound.

Figure 5:
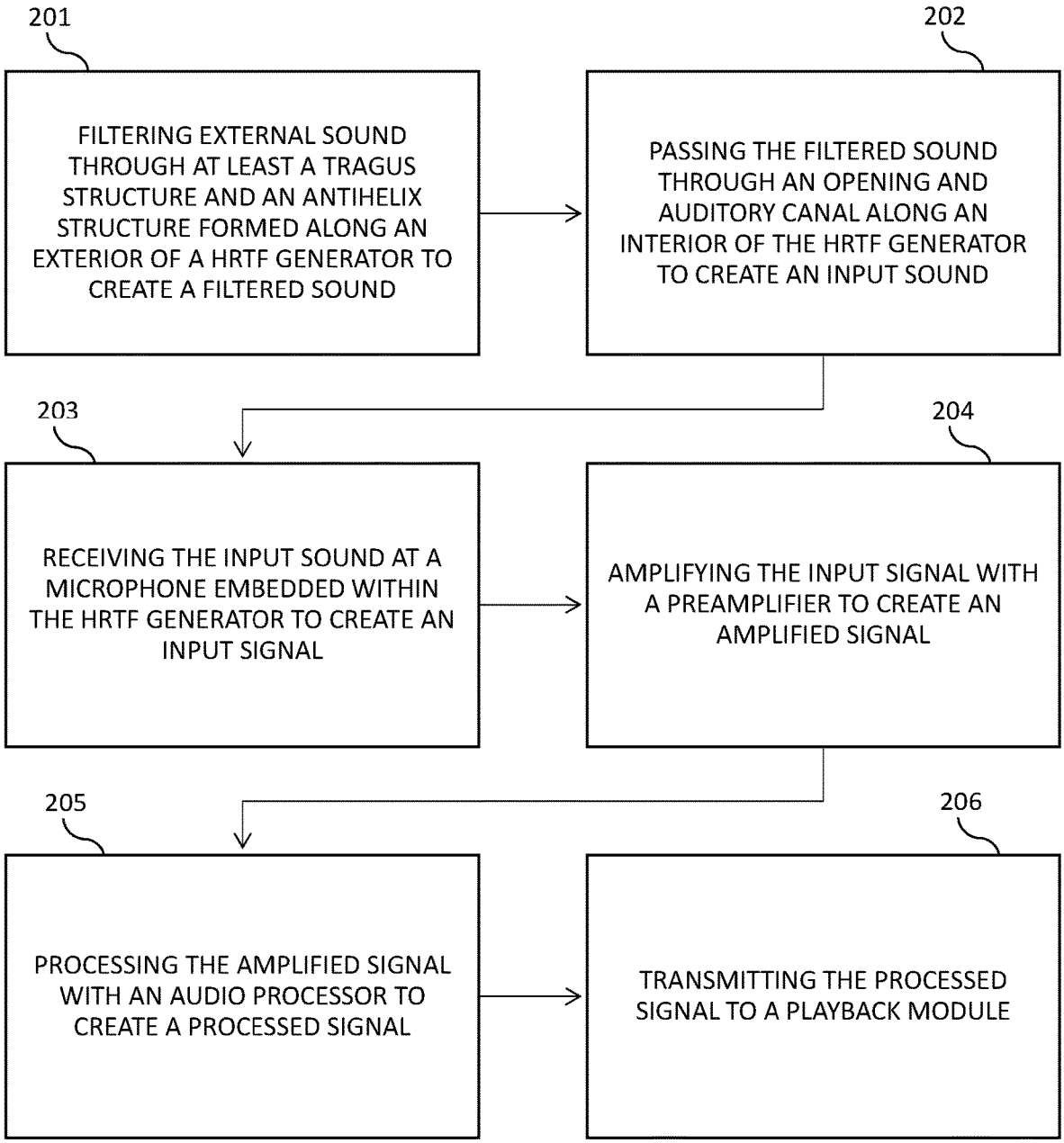
FIG. 5 illustrates a flowchart directed to a method for generating a head related audio transfer function.

In a further embodiment as illustrated in FIG. 5, a method for generating a head related audio transfer function is shown. Accordingly, external sound is first filtered through at least a tragus structure and an antihelix structure formed along an exterior of an HRTF generator, as in 201, in order to create a filtered sound. Next, the filtered sound is passed through an opening and auditory canal along an interior of the HRTF generator, as in 202, in order to create an input sound. The input sound is received at a microphone embedded within the HRTF generator, as in 203, in order to create an input signal. The input signal is then amplified with a preamplifier, as in 204, in order to create an amplified signal. The amplified signal is processed with an audio processor, as in 205, in order to create a processed signal. Finally, the processed signal is transmitted to a playback module, as in 206, in order to relay the audio and/or locational audio data to the user.

In a preferred embodiment of the present invention, the method of FIG. 5 may perform the locational audio capture and transmission to a user in real time. This facilitates usage in a hearing assistance situation, such as a hearing aid for a user with impaired hearing. This also facilitates usage in a high noise environment, such as to filter out noises and/or enhancing human speech.

In at least one embodiment, the method of FIG. 5 may further comprise a calibration process, such that each user can replicate his or her unique HRTF in order to provide for accurate localization of a sound in three dimensional space. The calibration may comprise adjusting the antihelix and tragus structures as described above, which may be formed of modular and/or moveable components. Thus, the antihelix and/or tragus structure may be repositioned, and/or differently shaped and/or sized structures may be used. In further embodiments, the audio processor 230 described above may be further calibrated to adjust the acoustic enhancement of certain sound waves relative to other sound waves and/or signals.

Figure 6:
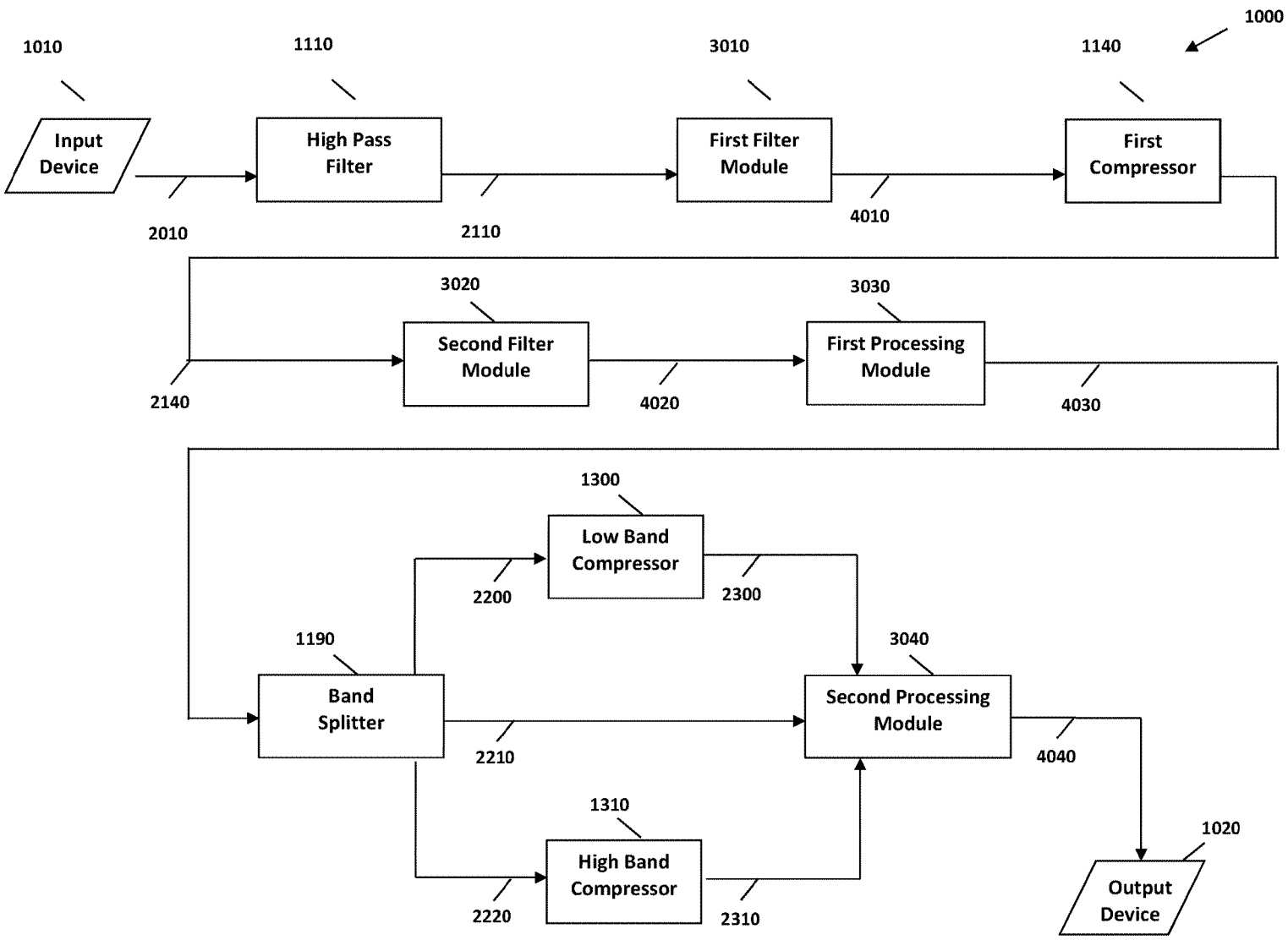
FIG. 6 illustrates a schematic of one embodiment of an audio processor according to one embodiment of the present invention.
Figure 7:
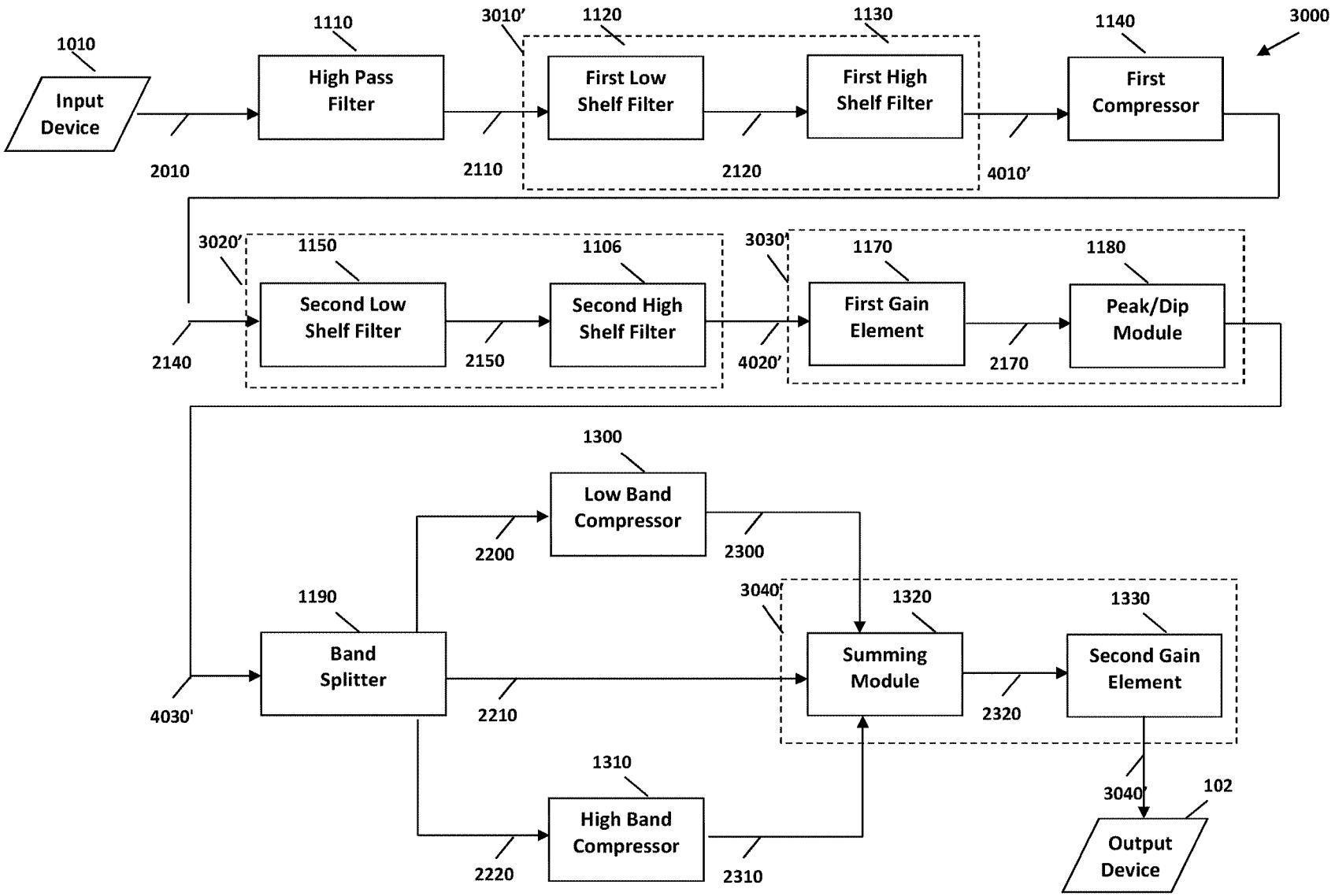
FIG. 7 illustrates a schematic of another embodiment of an audio processor according to one embodiment of the present invention.

With regard to FIG. 6, one embodiment of an audio processor 230 is represented schematically as a system 1000. As schematically represented, FIG. 6 illustrates at least one preferred embodiment of a system 1000, and FIG. 7 provides examples of several subcomponents and combinations of subcomponents of the modules of FIG. 6. Accordingly, and in these embodiments, the systems 1000 and 3000 generally comprise an input device 1010 (such as the left preamplifier 210 and/or right preamplifier 210'), a high pass filter 1110, a first filter module 3010, a first compressor 1140, a second filter module 3020, a first processing module 3030, a band splitter 1190, a low band compressor 1300, a high band compressor 1310, a second processing module 3040, and an output device 1020.

The input device 1010 is at least partially structured or configured to transmit an input audio signal 2010, such as an amplified signal from a left or right preamplifier 210, 210', into the system 1000 of the present invention, and in at least one embodiment into the high pass filter 1110.

The high pass filter 1110 is configured to pass through high frequencies of an audio signal, such as the input signal 2010, while attenuating lower frequencies, based on a predetermined frequency. In other words, the frequencies above the predetermined frequency may be transmitted to the first filter module 3010 in accordance with the present invention. In at least one embodiment, ultra-low frequency content is removed from the input audio signal, where the predetermined frequency may be selected from a range between 300 Hz and 3 kHz. The predetermined frequency however, may vary depending on the source signal, and vary in other embodiments to comprise any frequency selected from the full audible range of frequencies between 20 Hz to 20 kHz. The predetermined frequency may be tunable by a user, or alternatively be statically set. The high pass filter 1110 may further comprise any circuits or combinations thereof structured to pass through high frequencies above a predetermined frequency, and attenuate or filter out the lower frequencies.

The first filter module 3010 is configured to selectively boost or attenuate the gain of select frequency ranges within an audio signal, such as the high pass signal 2110. For example, and in at least one embodiment, frequencies below a first frequency may be adjusted by ±X dB, while frequencies above a first frequency may be adjusted by ±Y dB. In other embodiments, a plurality of frequencies may be used to selectively adjust the gain of various frequency ranges within an audio signal. In at least one embodiment, the first filter module 3010 may be implemented with a first low shelf filter 1120 and a first high shelf filter 1130, as illustrated in FIG. 6. The first low shelf filter 1120 and first high shelf filter 1130 may both be second-order filters. In at least one embodiment, the first low shelf filter 1120 attenuates content below a first frequency, and the first high shelf filter 1120 boosts content above a first frequency. In other embodiments, the frequency used for the first low shelf filter 1120 and first high shelf filter 1130 may comprise two different frequencies. The frequencies may be static or adjustable. Similarly, the gain adjustment (boost or attenuation) may be static or adjustable.

The first compressor 1140 is configured to modulate a signal, such as the first filtered signal 4010. The first compressor 1120 may comprise an automatic gain controller. The first compressor 1120 may comprise standard dynamic range compression controls such as threshold, ratio, attack and release. Threshold allows the first compressor 1120 to reduce the level of the filtered signal 2110 if its amplitude exceeds a certain threshold. Ratio allows the first compressor 1120 to reduce the gain as determined by a ratio. Attack and release determines how quickly the first compressor 1120 acts. The attack phase is the period when the first compressor 1120 is decreasing gain to reach the level that is determined by the threshold. The release phase is the period that the first compressor 1120 is increasing gain to the level determined by the ratio. The first compressor 1120 may also feature soft and hard knees to control the bend in the response curve of the output or modulated signal 2120, and other dynamic range compression controls appropriate for the dynamic compression of an audio signal. The first compressor 1120 may further comprise any device or combination of circuits that is structured and configured for dynamic range compression.

The second filter module 3020 is configured to selectively boost or attenuate the gain of select frequency ranges within an audio signal, such as the modulated signal 2140. In at least one embodiment, the second filter module 3020 is of the same configuration as the first filter module 3010. Specifically, the second filter module 3020 may comprise a second low shelf filter 1150 and a second high shelf filter 1160. In certain embodiments, the second low shelf filter 1150 may be configured to filter signals between 100 Hz and 3000 Hz, with an attenuation of between −5 dB to −20 dB. In certain embodiments the second high shelf filter 1160 may be configured to filter signals between 100 Hz and 3000 Hz, with a boost of between +5 dB to +20 dB.

The second filter module 3020 may be configured in at least a partially inverse configuration to the first filter module 3010. For instance, the second filter module may use the same frequency, for instance the first frequency, as the first filter module. Further, the second filter module may adjust the gain inversely to the gain or attenuation of the first filter module, of content above the first frequency. Similarly second filter module may also adjust the gain inversely to the gain or attenuation of the of the first filter module, of content below the first frequency. In other words, the purpose of the second filter module in one embodiment may be to "undo" the gain adjustment that was applied by the first filter module.

The first processing module 3030 is configured to process a signal, such as the second filtered signal 4020. In at least one embodiment, the first processing module 3030 may comprise a peak/dip module, such as 1180 represented in FIG. 7. In other embodiments, the first processing module 3030 may comprise a first gain element 1170. In various embodiments, the processing module 3030 may comprise both a first gain element 1170 and a peak/dip module 1180 for the processing of a signal. The first gain element 1170, in at least one embodiment, may be configured to adjust the level of a signal by a static amount. The first gain element 1170 may comprise an amplifier or a multiplier circuit. In other embodiments, dynamic gain elements may be used. The peak/dip module 1180 is configured to shape the desired output spectrum, such as to increase or decrease overshoots or undershoots in the signal. In some embodiments, the peak/dip module may further be configured to adjust the slope of a signal, for instance for a gradual scope that gives a smoother response, or alternatively provide for a steeper slope for more sudden sounds. In at least one embodiment, the peak/dip module 1180 comprises a bank of ten cascaded peak/dipping filters. The bank of ten cascaded peaking/dipping filters may further be second-order filters. In at least one embodiment, the peak/dip module 1180 may comprise an equalizer, such as parametric or graphic equalizers.

The band splitter 1190 is configured to split a signal, such as the processed signal 4030. In at least one embodiment, the signal is split into a low band signal 2200, a mid band signal 2210, and a high band signal 2220. Each band may be the output of a fourth order section, which may be further realized as the cascade of second order biquad filters. In other embodiments, the band splitter may comprise any combination of circuits appropriate for splitting a signal into three frequency bands. The low, mid, and high bands may be predetermined ranges, or may be dynamically determined based on the frequency itself, i.e. a signal may be split into three even frequency bands, or by percentage. The different bands may further be defined or configured by a user and/or control mechanism.

A low band compressor 1300 is configured to modulate the low band signal 2200, and a high band compressor 1310 is configured to modulate the high band signal 2220. In at least one embodiment, each of the low band compressor 1300 and high band compressor 1310 may be the same as the first compressor 1140. Accordingly, each of the low band compressor 1300 and high band compressor 1310 may each be configured to modulate a signal. Each of the compressors 1300, 1310 may comprise an automatic gain controller, or any combination of circuits appropriate for the dynamic range compression of an audio signal.

A second processing module 3040 is configured to process at least one signal, such as the modulated low band signal 2300, the mid band signal 2210, and the modulated high band signal 2310. Accordingly, the second processing module 3040 may comprise a summing module 1320 configured to combine a plurality of signals. The summing module 1320 may comprise a mixer structured to combine two or more signals into a composite signal. The summing module 1320 may comprise any circuits or combination thereof structured or configured to combine two or more signals. In at least one embodiment, the summing module 1320 comprises individual gain controls for each of the incoming signals, such as the modulated low band signal 2300, the mid band signal 2210, and the modulated high band signal 2310. In at least one embodiment, the second processing module 3040 may further comprise a second gain element 1330. The second gain element 1330, in at least one embodiment, may be the same as the first gain element 1170. The second gain element 1330 may thus comprise an amplifier or multiplier circuit to adjust the signal, such as the combined signal, by a predetermined amount.

The output device 1020 may comprise the left playback module 230 and/or right playback module 230'.

Figure 8:
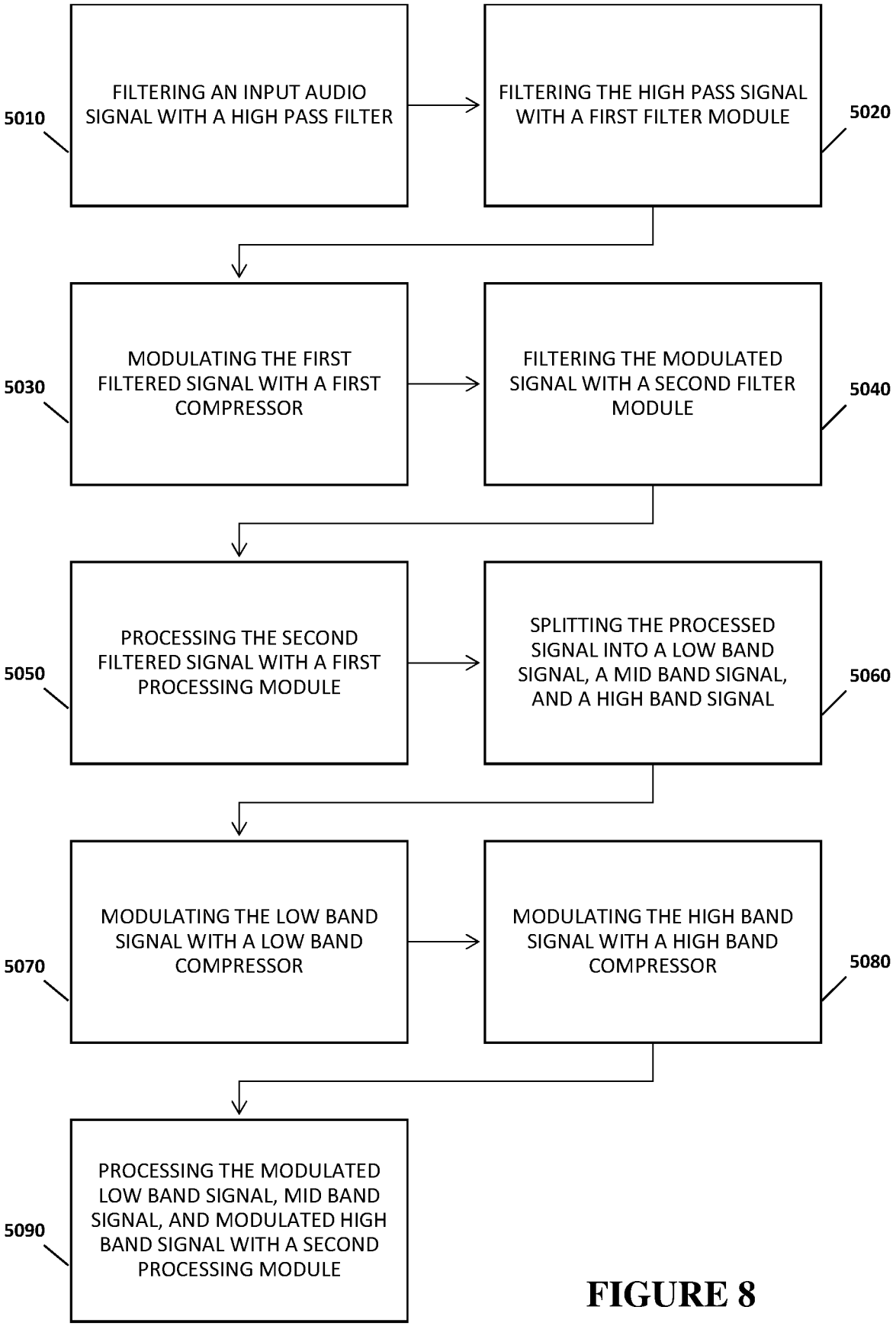
FIG. 8 illustrates a block diagram of one method for processing an audio signal with an audio processor according to one embodiment of the present invention.

As diagrammatically represented, FIG. 8 illustrates a block diagram of one method for processing an audio signal with an audio processor 220, which may in at least one embodiment incorporate the components or combinations thereof from the systems 1000 and/or 3000 referenced above. Each step of the method in FIG. 8 as detailed below may also be in the form of a code segment stored on a non-transitory computer readable medium for execution by the audio processor 220.

Accordingly, an input audio signal, such as the amplified signal, is first filtered, as in 5010, with a high pass filter to create a high pass signal. The high pass filter is configured to pass through high frequencies of a signal, such as the input signal, while attenuating lower frequencies. In at least one embodiment, ultra-low frequency content is removed by the high-pass filter. In at least one embodiment, the high pass filter may comprise a fourth-order filter realized as the cascade of two second-order biquad sections. The reason for using a fourth order filter broken into two second order sections is that it allows the filter to retain numerical precision in the presence of finite word length effects, which can happen in both fixed and floating point implementations. An example implementation of such an embodiment may assume a form similar to the following:

Two memory locations are allocated, designated as d(k−1) and d(k−2), with each holding a quantity known as a state variable. For each input sample x(k), a quantity d(k) is calculated using the coefficients a1 and a2:

$$d(k)=x(k)-a1*d(k-1)-a2*d(k-2)$$

The output y(k) is then computed, based on coefficients b0, b1, and b2, according to:

$$y(k)=b0*d(k)+b1*d(k-1)+b2*d(k-2)$$

The above computation comprising five multiplies and four adds is appropriate for a single channel of second-order biquad section. Accordingly, because the fourth-order high pass filter is realized as a cascade of two second-order biquad sections, a single channel of fourth order input high pass filter would require ten multiples, four memory locations, and eight adds.

The high pass signal from the high pass filter is then filtered, as in 5020, with a first filter module to create a first filtered signal. The first filter module is configured to selectively boost or attenuate the gain of select frequency ranges within an audio signal, such as the high pass signal. Accordingly, the first filter module may comprise a second order low shelf filter and a second order high shelf filter in at least one embodiment. In at least one embodiment, the first filter module boosts the content above a first frequency by a certain amount, and attenuates the content below a first frequency by a certain amount, before presenting the signal to a compressor or dynamic range controller. This allows the dynamic range controller to trigger and adjust higher frequency material, whereas it is relatively insensitive to lower frequency material.

The first filtered signal from the first filter module is then modulated, as in 5030, with a first compressor. The first compressor may comprise an automatic or dynamic gain controller, or any circuits appropriate for the dynamic compression of an audio signal. Accordingly, the compressor may comprise standard dynamic range compression controls such as threshold, ratio, attack and release. An example implementation of the first compressor may assume a form similar to the following:

The compressor first computes an approximation of the signal level, where att represents attack time; rel represents release time; and invThr represents a precomputed threshold:

```
temp = abs (x(k))
if temp > level (k−1)
    level(k) = att * (level(k−1) − temp) + temp
else
    level = rel * (level(k−1) − temp) + temp
```

This level computation is done for each input sample. The ratio of the signal's level to invThr then determines the next step. If the ratio is less than one, the signal is passed through unaltered. If the ratio exceeds one, a table in the memory may provide a constant that's a function of both invThr and level:

```
if (level * thr < 1)
    output(k) = x(k)
else
    index = floor(level * invThr)
if (index > 99)
    index = 99
gainReduction = table[index]
output(k) = gainReduction * x(k)
```

The modulated signal from the first compressor is then filtered, as in 5040, with a second filter module to create a second filtered signal. The second filter module is configured to selectively boost or attenuate the gain of select frequency ranges within an audio signal, such as the modulated signal. Accordingly, the second filter module may comprise a second order low shelf filter and a second order high shelf filter in at least one embodiment. In at least one embodiment, the second filter module boosts the content above a second frequency by a certain amount, and attenuates the content below a second frequency by a certain amount. In at least one embodiment, the second filter module adjusts the content below the first specified frequency by a fixed amount, inverse to the amount that was removed by the first filter module. By way of example, if the first filter module boosted content above a first frequency by +X dB and attenuated content below a first frequency by −Y dB, the second filter module may then attenuate the content above the first frequency by −X dB, and boost the content below the first frequency by +Y dB. In other words, the purpose of the second filter module in one embodiment may be to "undo" the filtering that was applied by the first filter module.

The second filtered signal from the second filter module is then processed, as in 5050, with a first processing module to create a processed signal. The processing module may comprise a gain element configured to adjust the level of the signal. This adjustment, for instance, may be necessary because the peak-to-average ratio was modified by the first compressor. The processing module may comprise a peak/dip module. The peak/dip module may comprise ten cascaded second-order filters in at least one embodiment. The peak/dip module may be used to shape the desired output spectrum of the signal. In at least one embodiment, the first processing module comprises only the peak/dip module. In other embodiments, the first processing module comprises a gain element followed by a peak/dip module.

The processed signal from the first processing module is then split, as in 5060, with a band splitter into a low band signal, a mid band signal, and a high band signal. The band splitter may comprise any circuit or combination of circuits appropriate for splitting a signal into a plurality of signals of different frequency ranges. In at least one embodiment, the band splitter comprises a fourth-order band-splitting bank. In this embodiment, each of the low band, mid band, and high band are yielded as the output of a fourth-order section, realized as the cascade of second-order biquad filters.

The low band signal is modulated, as in 5070, with a low band compressor to create a modulated low band signal. The low band compressor may be configured and/or computationally identical to the first compressor in at least one embodiment. The high band signal is modulated, as in 5080, with a high band compressor to create a modulated high band signal. The high band compressor may be configured and/or computationally identical to the first compressor in at least one embodiment.

The modulated low band signal, mid band signal, and modulated high band signal are then processed, as in 5090, with a second processing module. The second processing module comprises at least a summing module. The summing module is configured to combine a plurality of signals into one composite signal. In at least one embodiment, the summing module may further comprise individual gain controls for each of the incoming signals, such as the modulated low band signal, the mid band signal, and the modulated high band signal. By way of example, an output of the summing module may be calculated by:

$$out = w0*low + w1*mid + w2*high$$

The coefficients w0, w1, and w2 represent different gain adjustments. The second processing module may further comprise a second gain element. The second gain element may be the same as the first gain element in at least one embodiment. The second gain element may provide a final gain adjustment. Finally, the second processed signal is transmitted as the output signal.

Figure 9:
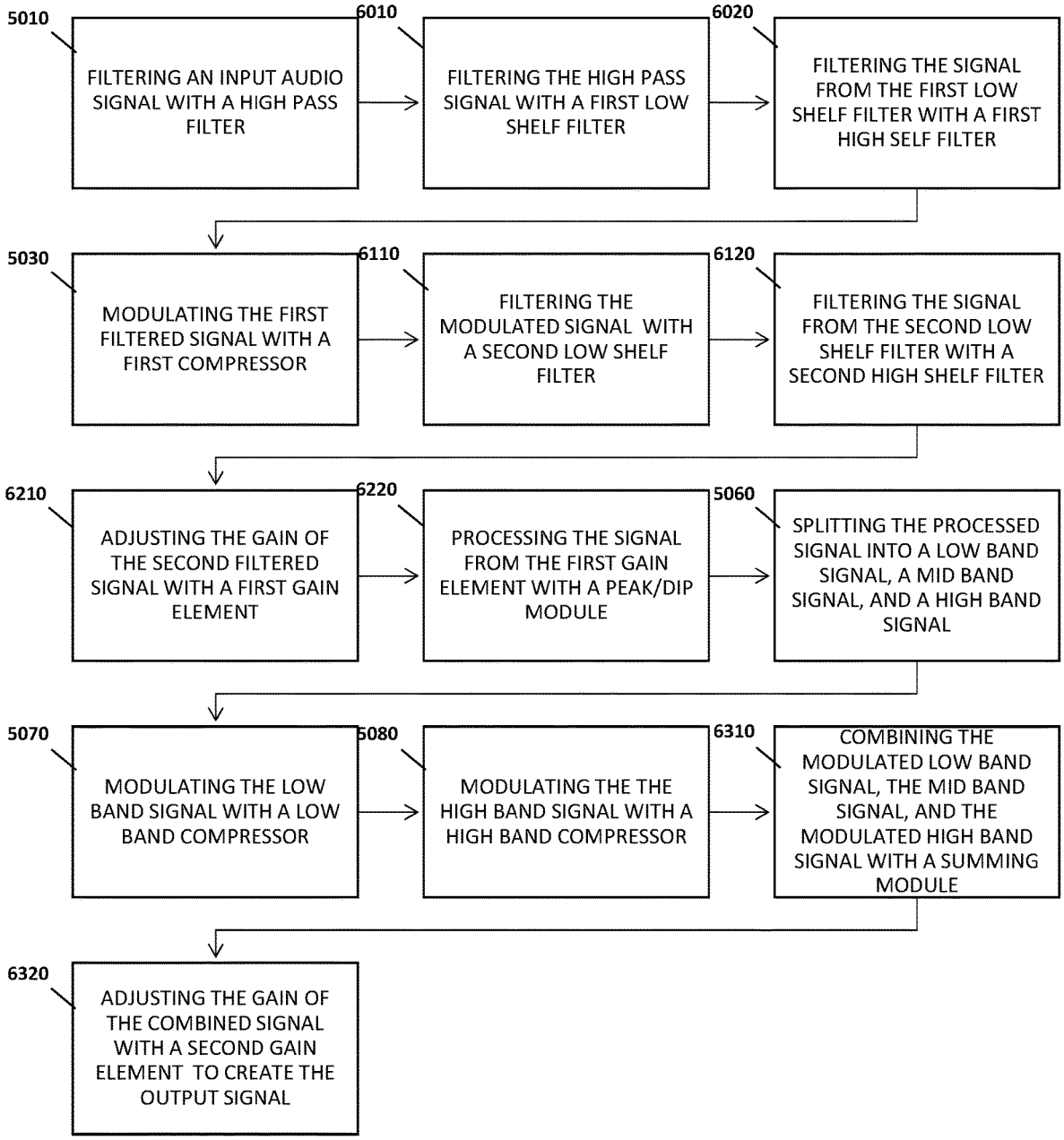
FIG. 9 illustrates a block diagram of another method for processing an audio signal with an audio processor according to another embodiment of the present invention.

As diagrammatically represented, FIG. 9 illustrates a block diagram of one method for processing an audio signal with an audio processor 220, which may in at least one embodiment incorporate the components or combinations thereof from the systems 1000 and/or 3000 referenced above. Because the individual components of FIG. 9 have been discussed in detail above, they will not be discussed here. Further, each step of the method in FIG. 9 as detailed below may also be in the form of a code segment directed to at least one embodiment of the present invention, which is stored on a non-transitory computer readable medium, for execution by the audio processor 220 of the present invention.

Accordingly, an input audio signal is first filtered, as in 5010, with a high pass filter. The high pass signal from the high pass filter is then filtered, as in 6010, with a first low shelf filter. The signal from the first low shelf filter is then filtered with a first high shelf filter, as in 6020. The first filtered signal from the first low shelf filter is then modulated with a first compressor, as in 5030. The modulated signal from the first compressor is filtered with a second low shelf filter as in 6110. The signal from the low shelf filter is then filtered with a second high shelf filter, as in 6120. The second filtered signal from the second low shelf filter is then gain-adjusted with a first gain element, as in 6210. The signal from the first gain element is further processed with a peak/dip module, as in 6220. The processed signal from the peak/dip module is then split into a low band signal, a mid band signal, and a high band signal, as in 5060. The low band signal is modulated with a low band compressor, as in 5070. The high band signal is modulated with a high band compressor, as in 5080. The modulated low band signal, mid band signal, and modulated high band signal are then combined with a summing module, as in 6310. The combined signal is then gain adjusted with a second gain element in order to create the output signal, as in 6320.

It should be understood that the above steps may be conducted exclusively or nonexclusively and in any order. Further, the physical devices recited in the methods may comprise any apparatus and/or systems described within this document or known to those skilled in the art.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An apparatus for generating a head related audio transfer function for a user, said apparatus comprising:

an external manifold disposed at least partially on an exterior of said apparatus, said external manifold comprising:

an opening disposed along an exterior of said external manifold, said opening in air flow communication with the external environment, a tragus structure disposed to partially enclose said opening, an antihelix structure disposed to partially enclose said tragus structure and said opening, an opening canal in air flow communication with said opening, an internal manifold disposed along an interior of said apparatus, said internal manifold comprising:

an auditory canal in air flow communication with said opening canal, a microphone housing attached to an end of said auditory canal, said microphone housing comprising a microphone, an air cavity in air flow communication with said auditory canal;

left and right preamplifiers configured to receive an audio signal, an audio processor configured to receive an amplified signal, and a playback module configured to receive a processed signal;

said audio processor including at least a high pass filter, a first low shelf filter, a first high shelf filter, a first compressor, a second low shelf filter, a second high shelf filter, a first processing module, a band splitter, a low band compressor, a high band compressor, and a second processing module;

said high pass filter configured to filter an amplified signal to create a high pass high pass signal;

said first low shelf filter configured to filter said high pass signal to create a first low shelf signal;

said first high shelf filter configured to filter said first low shelf signal to create a first filtered signal;

said first compressor configured to compress said first filtered signal to create a modulated signal;

said second low shelf filter configured to filter said modulated signal to create a second low shelf signal;

said second high shelf filter configured to filter said second low shelf signal to create a second filtered signal;

said first processing module configured to process said second filtered signal to create a processed signal;

said band splitter configured to split said processed signal into a low band signal, a mid band signal and a high band signal;

said low band compressor configured to compress said low band signal to create a modulated low band signal, said high band compressor configured to compress said high band signal to create a modulated high band signal; and said second processing module configured to process said modulated low band signal, said mid band signal and said modulated high band signal to create a processed signal.

2. A system for generating a head related audio transfer function (HRTF) for a user, said system comprising:

a left HRTF generator structured and disposed to pick up sound signals to the left side of the user;

a right HRTF generator structured and disposed to pick up sound signals to the right side of the user;

at least one audio processor including at least a high pass filter, a first low shelf filter, a first high shelf filter, a first compressor, a second low shelf filter, a second high shelf filter, a first processing module, a band splitter, a low band compressor, a high band compressor, and a second processing module;

said high pass filter configured to filter an amplified signal to create a high pass high pass signal;

said first low shelf filter configured to filter said high pass signal to create a first low shelf signal;

said first high shelf filter configured to filter said first low shelf signal to create a first filtered signal;

said first compressor configured to compress said first filtered signal to create a modulated signal;

said second low shelf filter configured to filter said modulated signal to create a second low shelf signal;

said second high shelf filter configured to filter said second low shelf signal to create a second filtered signal;

said first processing module configured to process said second filtered signal to create a first processed signal;

said band splitter configured to split said processed signal into a low band signal, a mid band signal and a high band signal;

said low band compressor configured to compress said low band signal to create a modulated low band signal, said high band compressor configured to compress said high band signal to create a modulated high band signal;

said second processing module configured to process said modulated low band signal, said mid band signal and said modulated high band signal to create a second processed signal;

a left playback module structured and configured to relay positional audio data to the user's left ear; and a right playback module structured and configured to relay positional audio data to the user's right ear.

3. The system as recited in claim 2 wherein each of said left and right HRTF generators comprise the apparatus of claim 1.

4. The system as recited in claim 2 further comprising a left preamplifier structured to enhance the sound signals of the left HRTF generator, creating an amplified signal.

5. The system as recited in claim 4 further comprising a right preamplifier structured to enhance the sound signals of the right HRTF generator, creating an amplified signal.

6. The system as recited in claim 2 wherein said at least one audio processor further comprises a volume control for adjusting an input volume picked up from each of the left and right HRTF generators.

7. The system as recited in claim 2 wherein said at least one audio processor further comprises a post-amplifier for adjusting an output volume from said at least one audio processor.

8. A system as recited in claim 2 wherein said second low shelf filter is configured to filter signals between 100 Hz and 3000 Hz, with an attenuation of between −5 db to −20 dB.

9. A system as recited in claim 2 wherein said second high shelf filter is configured to filter signals between 100 Hz and 3000 Hz, with a boost of between +5 db to +20 dB.

10. A system as recited in claim 2 wherein said first processing module comprises a peak/dip module configured to process said second filtered signal to create said first processed signal.

11. A system as recited in claim 2 wherein said first processing module comprises:

a first gain element configured to adjust a gain level of said second filtered signal to create a first gain signal, a peak/dip module configured to process said first gain signal to create said first processed signal.

12. A system as recited in claim 2 wherein said second processing module comprises a summing module configured to combine said modulated low band signal, said mid band signal, and said modulated high band signal to create an output signal.

13. A system as recited in claim 2 wherein said second processing module comprises:

a summing module configured to combine said modulated low band signal, said mid band signal, and said modulated high band signal to create a combined signal, a second gain element configured to adjust a gain level of the combined signal to create an output signal.

14. A system as recited in claim 2 wherein said high pass filter comprises a fourth order high pass filter.

15. A system as recited in claim 2 wherein said first low shelf filter comprises a second order low shelf filter.

16. A system as recited in claim 2 wherein said first high shelf filter comprises a second order high shelf filter.

17. A system as recited in claim 2 wherein said second low shelf filter comprises a second order low shelf filter.

18. A system as recited in claim 2 wherein said second high shelf filter comprises a second order high shelf filter.

* * * * *